US007911151B2

(12) United States Patent
Xu

(10) Patent No.: US 7,911,151 B2
(45) Date of Patent: Mar. 22, 2011

(54) SINGLE DRIVER FOR MULTIPLE LIGHT EMITTING DIODES

(75) Inventor: Peng Xu, Danbury, CT (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 870 days.

(21) Appl. No.: 10/555,677

(22) PCT Filed: Apr. 22, 2004

(86) PCT No.: PCT/IB2004/001351

§ 371 (c)(1), (2), (4) Date: Nov. 4, 2005

(87) PCT Pub. No.: WO2004/100612

PCT Pub. Date: Nov. 18, 2004

(65) Prior Publication Data

US 2006/0232219 A1 Oct. 19, 2006

(51) Int. Cl.
*H05B 41/16* (2006.01)

(52) U.S. Cl. ..... 315/247; 315/291; 315/185 S; 315/312; 315/274

(58) Field of Classification Search ..... 362/800; 345/102, 204, 212, 82, 211, 214; 315/209 R, 315/224, 225, 219, 247, 246, 185 S, 312–326, 315/291, 307–311
See application file for complete search history.

(56) References Cited

U.S. PATENT DOCUMENTS 3,796,951 A * 3/1974 Joseph ..... 324/122
3,944,854 A * 3/1976 Keller
4,017,847 A * 4/1977 Burford et al. ..... 345/46
4,198,629 A * 4/1980 Marion ..... 345/46
4,686,425 A * 8/1987 Havel ..... 315/152
4,743,897 A * 5/1988 Perez ..... 345/212
5,365,145 A * 11/1994 Fields ..... 315/86
5,457,612 A * 10/1995 Carter ..... 362/473
5,523,927 A * 6/1996 Gokey ..... 362/103
6,053,622 A * 4/2000 Horowitz et al. ..... 362/276
6,150,771 A * 11/2000 Perry ..... 315/291
6,150,774 A 11/2000 Mueller et al.
6,198,405 B1 * 3/2001 Andersson et al. ..... 340/815.45
6,266,000 B1 7/2001 Jusuf et al.
6,507,159 B2 1/2003 Muthu
6,618,031 B1 * 9/2003 Bohn et al. ..... 345/83
6,697,402 B2 * 2/2004 Crawford ..... 372/38.03
6,888,529 B2 * 5/2005 Bruning et al. ..... 345/102
6,897,709 B2 * 5/2005 Henry ..... 327/536
7,088,334 B2 * 8/2006 Adachi et al. ..... 345/102

(Continued)

FOREIGN PATENT DOCUMENTS

EP 1016062 B1 8/2002

(Continued)

*Primary Examiner* — Tuyet Thi Vo

(57) ABSTRACT

A LED driver circuit (70, 80) employs a power source (IS, VS) for providing power at a power conversion frequency to a switching LED cell (30-32, 40-42). The switching LED cell (30-32, 40-42) switches between a radiating mode and a disabled mode at a LED driving frequency. In the radiating mode, the switching LED cell (30-32, 40-42) controls a flow of a LED current from the power source (IS, VS) through one or more LEDs (L11-LXY) to radiate a color of light from the LEDs (L11-LXY). In the disabled mode, the switching LED cell (30-32, 40-42) impedes the flow of the LED current from the power source (IS, VS) through the LEDs (L11-LXY).

4 Claims, 26 Drawing Sheets

U.S. PATENT DOCUMENTS

| | | | | |
|---|---|---|---|---|
| 2001/0033503 | A1* | 10/2001 | Hamp et al. | 363/73 |
| 2002/0101198 | A1 | 8/2002 | Kemp | |
| 2003/0057888 | A1 | 3/2003 | Archenhold et al. | |
| 2003/0117087 | A1* | 6/2003 | Barth et al. | 315/291 |
| 2004/0090403 | A1* | 5/2004 | Huang | 345/82 |

FOREIGN PATENT DOCUMENTS

| | | | |
|---|---|---|---|
| GB | 2201454 | A | 9/1988 |
| WO | WO99/10867 | | 3/1999 |

* cited by examiner

SINGLE DRIVER FOR MULTIPLE LIGHT EMITTING DIODES

CROSS REFERENCE TO RELATED APPLICATION

This application claims the benefit of provisional application Ser. No. 60/468,538, file May 7, 2003, which the subject matter is incorporated herein by reference.

The present invention generally relates to light emitting diodes ("LEDs"). The present invention specifically relates to a family of driver circuit arrangements for operating multiple LEDs in generating various colors of light including white light.

As is well known in the art, red LEDs, green LEDs, blue LEDs, and amber LEDs are utilized to generate various colors of light, including white light, in various applications (e.g., liquid crystal display backlighting and white light illumination). To generate a desired color of light, each colored LED is independently controlled to provide a proper ratio of red, green, blue and amber lights for generating the desired color of light (e.g., 50% red, 20% blue, 20% green and 10% amber). To this end, each colored LED has historically been operated by its own driver circuit. For example, U.S. Pat. No. 6,507,159 discloses three LED drivers to control red LEDs, green LEDs, and blue LEDs, respectively.

The present invention provides a single driver circuit having an independent light control capacity for multiple LEDs.

One form of the present invention is a LED driver circuit comprising a power source and a switching LED cell, which employs one or more LEDs for radiating a light of any color. In operation, the power source provides power at a power conversion frequency, and the switching LED cell switches between a radiating mode and a disabled mode at a LED driving frequency. During the radiating mode, a LED current flows from the power source through the LED(s) whereby the LED(s) radiate the light. During the disabled mode, the flow of the current from the power source through the LED(s) is impeded to prevent a radiation of the light from the LED(s).

A second form of the present invention is a switching LED cell comprising an input terminal, an output terminal, and one or more LEDs for radiating a light of any color. The switching LED cell switches between a radiating mode and a disabled mode at a LED driving frequency. During the radiating mode, a LED current flows from a power source applied between the input and output terminals through the LED(s) whereby the LED(s) radiate the light. During the disabled mode, the flow of the current from the power source through the LED(s) is impeded to prevent a radiation of the light from the LED(s).

The foregoing forms as well as other forms, features and advantages of the present invention will become further apparent from the following detailed description of the presently preferred embodiments, read in conjunction with the accompanying drawings. The detailed description and drawings are merely illustrative of the present invention rather than limiting, the scope of the present invention being defined by the appended claims and equivalents thereof.

FIGS. 1-6 and 12-17 illustrate a baseline LED matrix L11-LXY for designing a current-source driven switching LED cell (FIGS. 1-6) or a voltage-source driven switching LED cell (FIGS. 12-17) of the present invention. A LED design of either switching LED cell involves (1) a selection of one or more LEDs within LED matrix L11-LXY, where $X \geqq 1$ and $Y \geqq 1$, (2) a selection of a color for each LED selected from LED matrix L11-LXY, and (3) for multiple LED embodiments, a selection of one or more series connections and/or parallel connections of the multiple LEDs selected from LED matrix L11-LXY. For embodiments of either switching LED cell employing multiple LEDs, the LEDs having similar operating current specifications are preferably connected in series, and the LEDs having similar operating voltage specifications are preferably connected in parallel. Those having ordinary skill in the art will appreciate that a LED design of a switching LED cell of the present invention is without limit.

Figure 1:
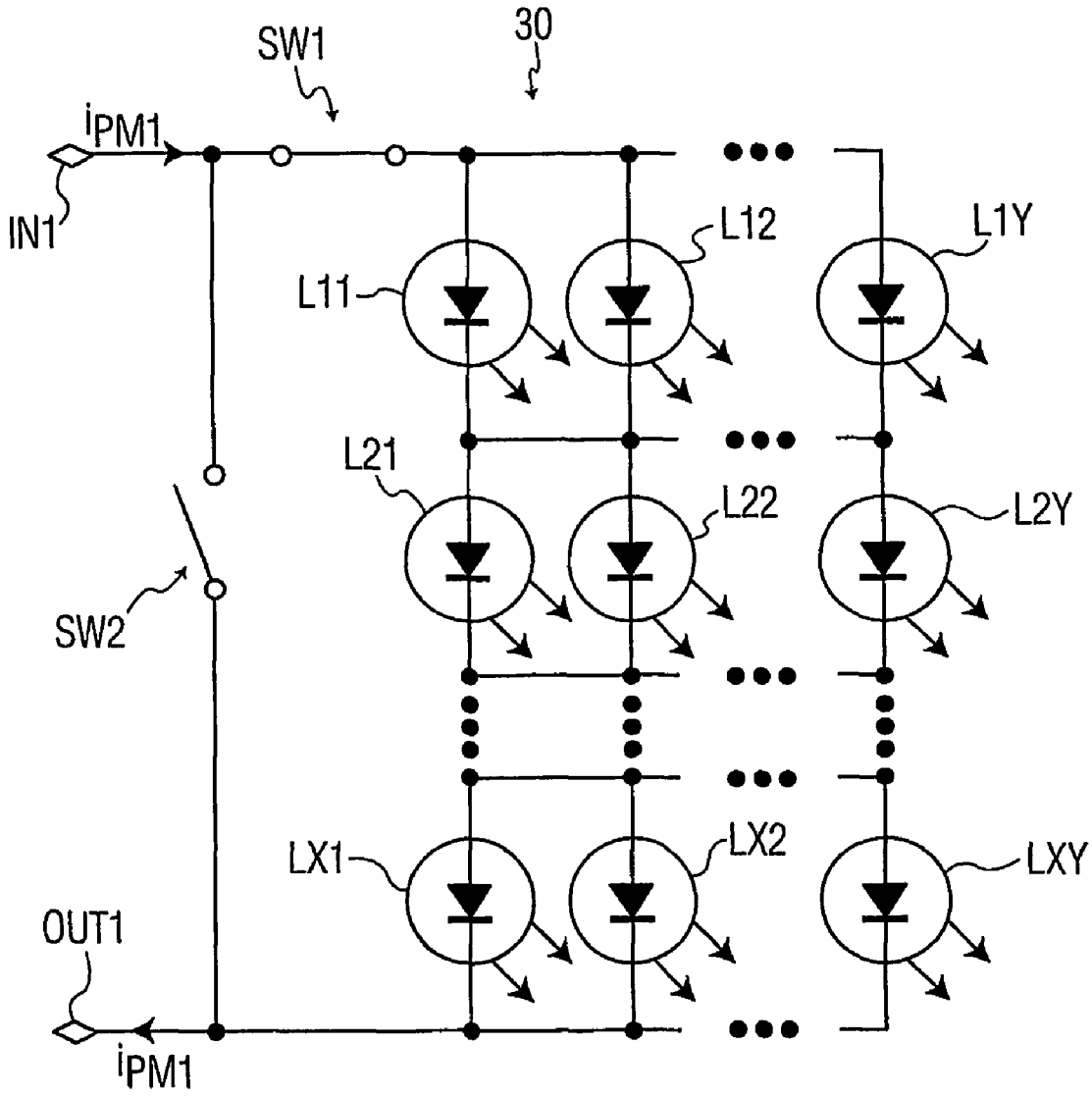
FIGS. 1 and 2 illustrate a schematic diagram of a first baseline embodiment in accordance with the present invention of a current-source driven switching LED cell.
Figure 2:
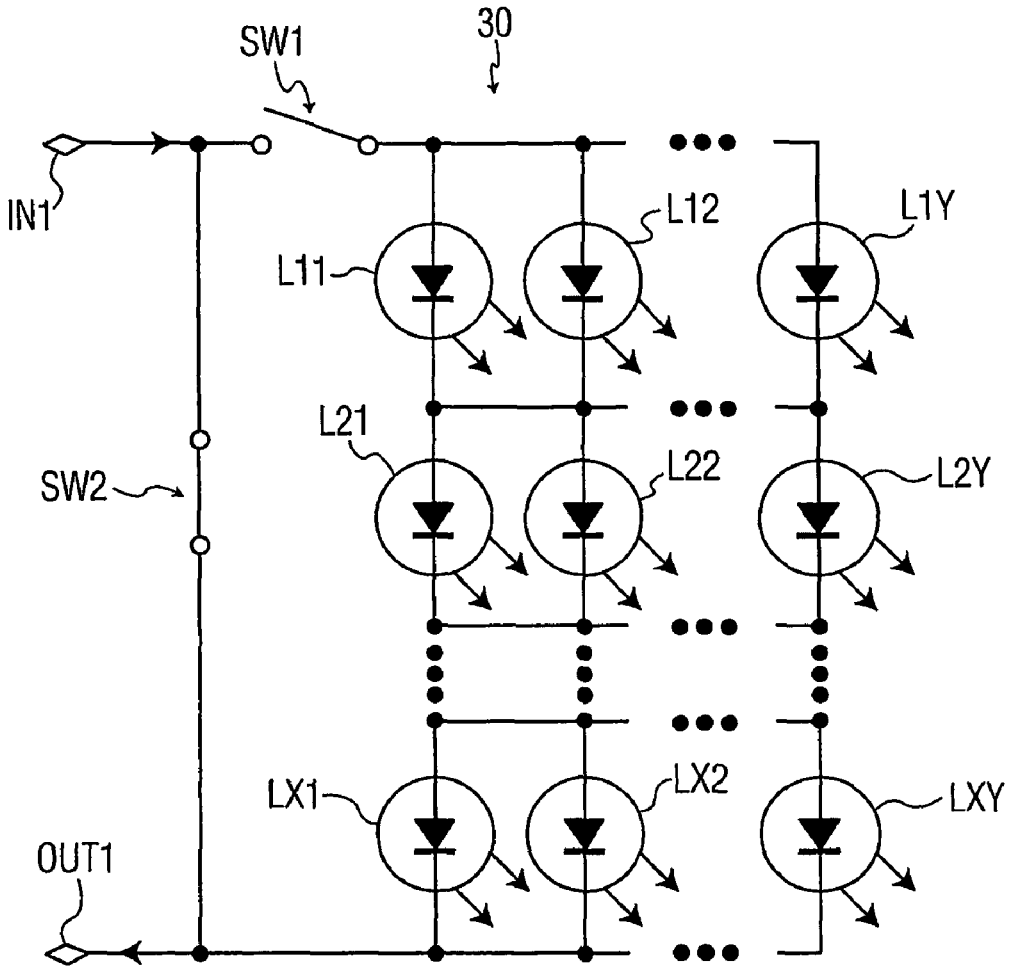

FIGS. 1 and 2 illustrate a baseline current-source driven switching LED cell 30 further employing a switch SW1 (e.g., a semiconductor switch) connected in series to LED matrix L11-LXY, and a switch SW2 (e.g., a semiconductor switch) connected in parallel to the series connection of switch SW1 and LED matrix L11-LXY. To facilitate an understanding of cell 30, the following description of the operation modes of cell 30 is based on an inclusion of each LED within LED matrix L11-LXY. However, in practice, a cell design of a current-source driven switching LED cell based on cell 30 can include any number and any arrangement of LEDs from LED matrix L11-LXY as would be appreciated by those having ordinary skill in the art.

In a radiating mode of cell 30 as illustrated in FIG. 1, switch SW1 is closed and switch SW2 is opened whereby a current $i_{PM1}$ can sequentially flow through an input terminal IN1, switch SW1, LED matrix L11-LXY, and an output terminal OUT1 to thereby radiate a color of light in dependence upon the selected color(s) of the LEDs. In a disabled mode of cell 30 as illustrated in FIG. 2, switch SW1 is opened and switch SW2 is closed to thereby impede a flow of current $i_{PM1}$ through LED matrix L11-LXY whereby the LEDs do not radiate the color of light. Current $i_{PM1}$ constitutes a pulse modulated current due to a complementary opening and closing of switches SW1 and SW2 at a LED driving frequency (e.g., 200 Hz), which can be accomplished by conventional techniques as would occur to those having ordinary skill in the art.

Multiple LED embodiments of switching LED cell 30 can further include one or more additional switches (e.g., semiconductor switches) distributed throughout the LEDs of LED matrix L11-LXY whereby a color level and/or a color intensity of the light radiated by the LEDs can be varied in dependence on an opening and a closing of the additional switches relative to the opening and closing of switches SW1 and SW2 as illustrated in FIGS. 1 and 2. Such multiple LED embodiments may operate switches SW1 and SW2 as well as the additional switches at the same or different LED driving frequencies. Current $i_{PM1}$ may consist of multiple pulse modulated currents at various LED driving frequencies in embodiments where the additional switches are individually operated at different LED driving frequencies or are operated in multiple groups at different LED driving frequencies.

Figure 3:
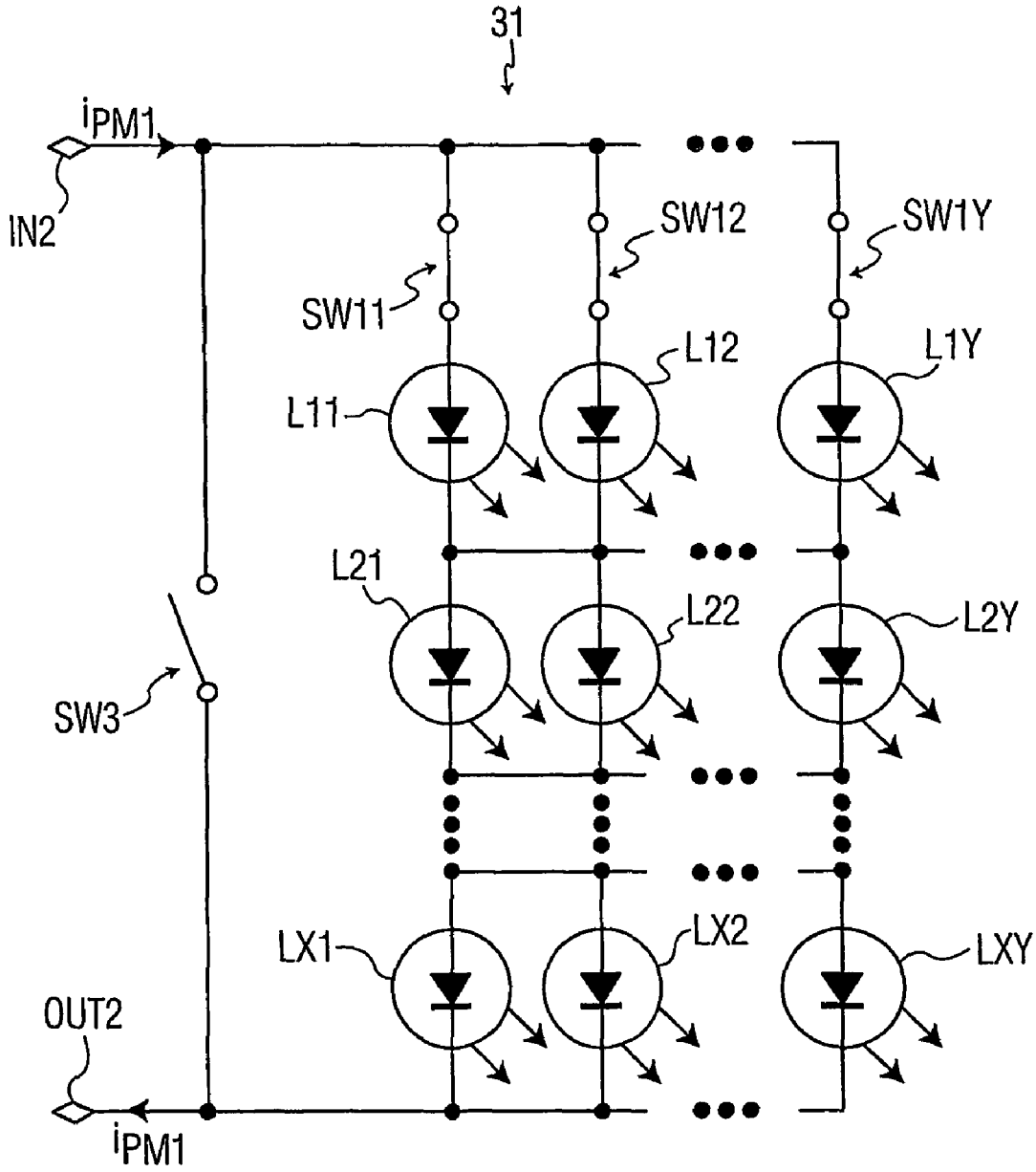
FIGS. 3 and 4 illustrate a schematic diagram of a second baseline embodiment in accordance with the present invention of a current-source driven switching LED cell.
Figure 4:
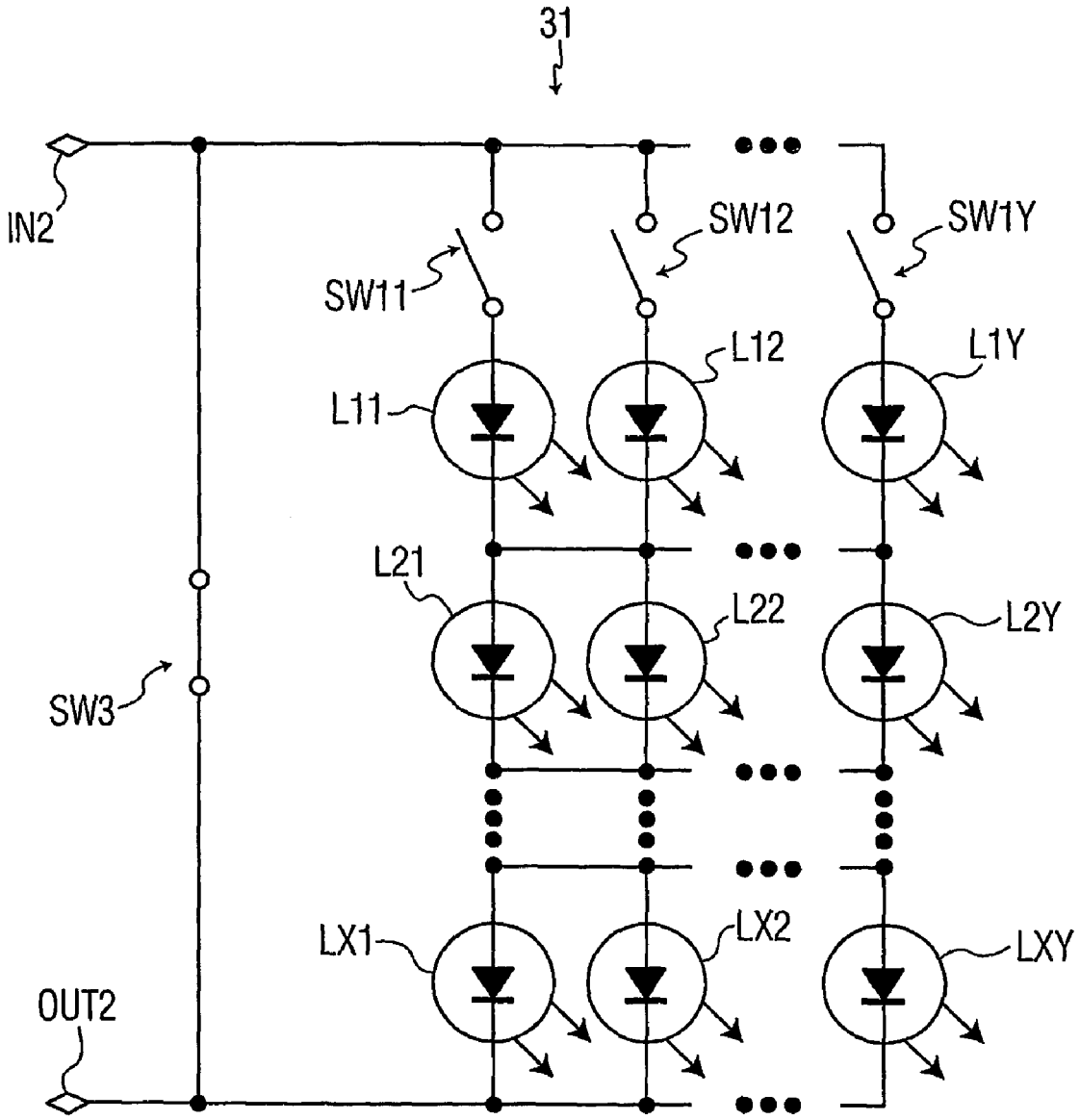

FIGS. 3 and 4 illustrate a baseline current-source driven switching LED cell 31 employing a circuit arrangement of switches SW11-SW1Y (e.g., semiconductor switches) connected to LED matrix L11-LXY. Cell 31 further employs a switch SW3 (e.g., a semiconductor switch) connected in parallel to the circuit arrangement of switches SW1-SW1Y and LED matrix L11-LYX. To facilitate an understanding of cell 31, the following description of the operation modes of cell 31 is based on an inclusion of each switch SW1-SW1Y and each LED within LED matrix L11-LXY. However, in practice, a cell design of a current-source driven switching LED cell based on cell 31 can include any number and any arrangement of switches SW11-SW1Y and LEDs of LED matrix L11-LXY as would be appreciated by those having ordinary skill in the art.

In a radiating mode of cell 31 as illustrated in FIG. 3, switch SW3 is opened and switches SW11-SW1Y are closed whereby current $i_{PM1}$ can sequentially flow through an input terminal IN2, switches SW11-SW1Y, LED matrix L11-LXY and an output terminal OUT2 to thereby radiate a color of light in dependence upon the selected color(s) of the LEDs. In a disabled mode of cell 31 as illustrated in FIG. 4, switch SW3 is closed and switches SW11-SW1Y are opened to thereby impede a flow of current $i_{PM1}$ through LED matrix L11-LXY whereby the LEDs do not radiate the color of light. Again, current $i_{PM1}$ constitutes a pulse modulated current due to the complementary opening and closing of switch SW3 and switches SW11-SW1Y at a LED driving frequency (e.g., 200 Hz), which can be accomplished by conventional techniques as would occur to those skilled in the art. In alternative operating embodiments of cell 31, switches SW11-SW1Y can be individually operated at different LED driving frequencies or operated in groups at different LED driving frequencies. In such a case, current $i_{PM1}$ may consist of multiple pulse-modulated currents at varying LED driving frequencies.

Embodiments of switching LED cell 31 can further include one or more additional switches (e.g., semiconductor switches) distributed throughout the LED matrix L11-LXY whereby a color level and/or a color intensity can be varied in dependence on an opening and a closing of the additional switches relative to the opening and closing of switch SW3 and switches SW11-SW1Y as illustrated in FIGS. 3 and 4. Such multiple LED embodiments may operate switch SW3 and switches SW11-SW1Y as well as the additional switches at the same or different LED driving frequencies. Current $i_{PM1}$ may consist of multiple pulse modulated currents at various LED driving frequencies in embodiments where the additional switches are individually operated at different LED driving frequencies or are operated in multiple groups at different LED driving frequencies.

Figure 5:
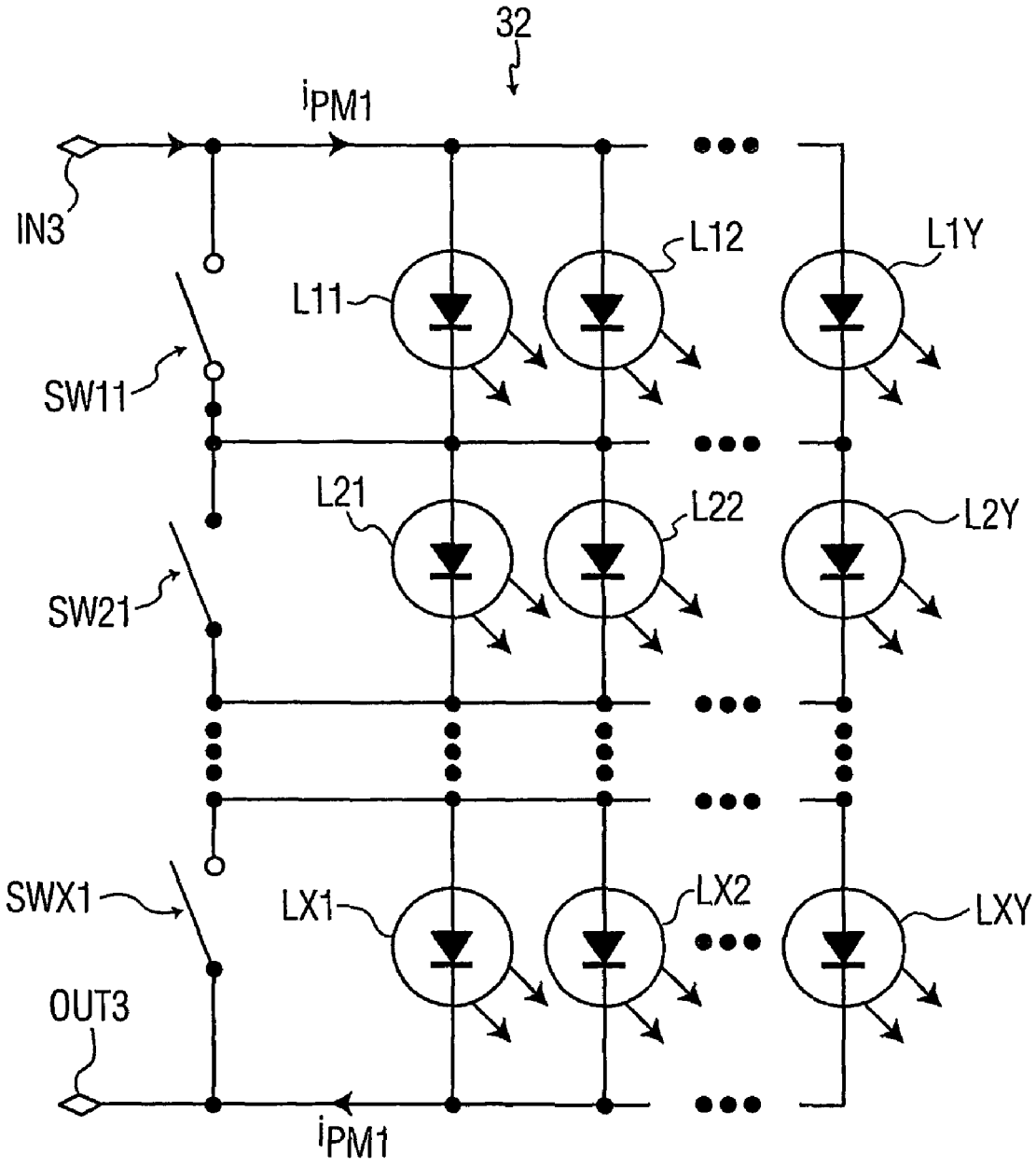
FIGS. 5 and 6 illustrate a schematic diagram of a third baseline embodiment in accordance with the present invention of a current-source driven switching LED cell.
Figure 6:
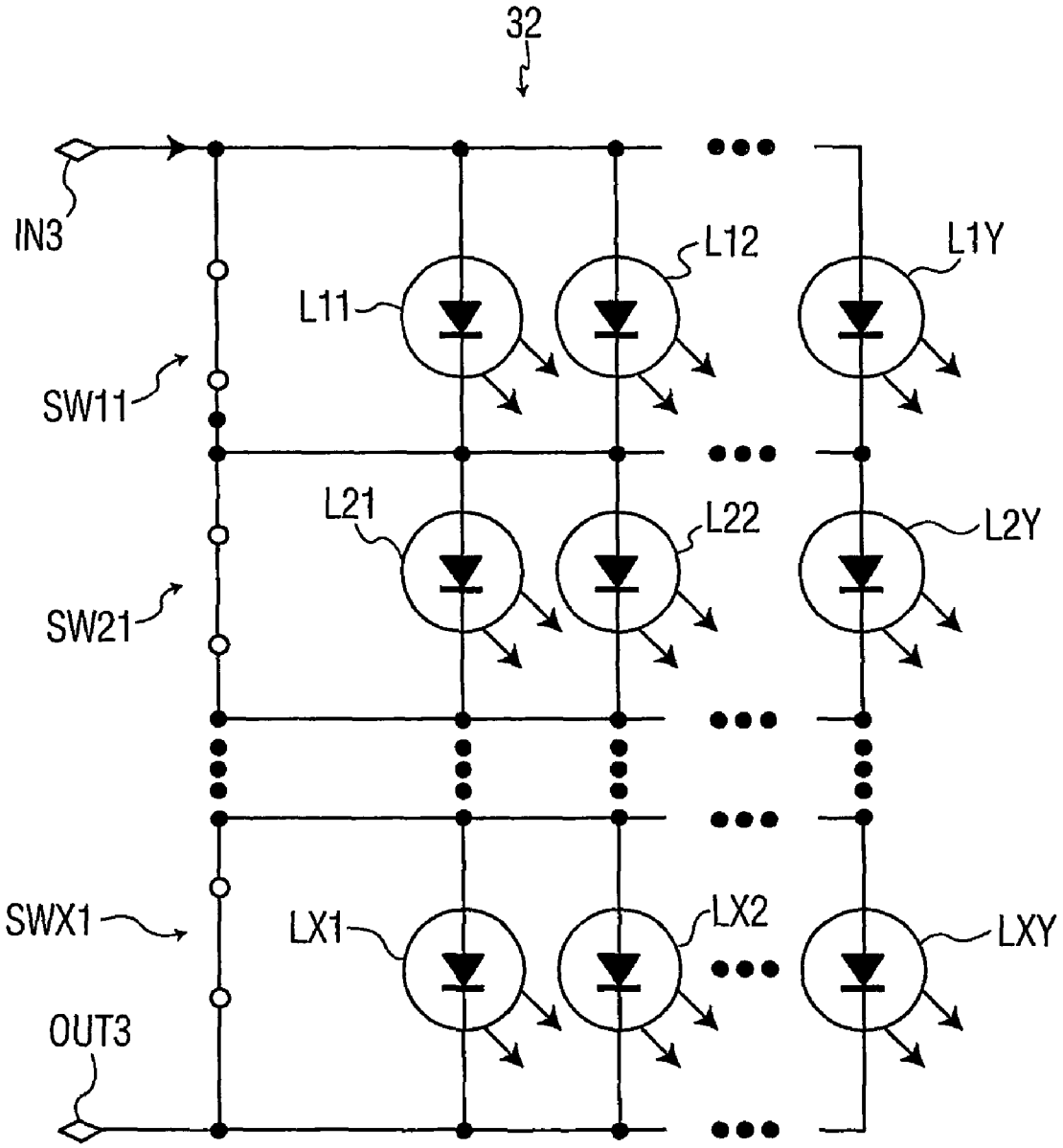

FIGS. 5 and 6 illustrate a baseline current-source driven switching LED cell 32 employing a circuit arrangement of switches SW11-SWX1 (e.g., semiconductor switches) connected to the LED matrix L11-LXY. To facilitate an understanding of cell 32, the following description of the operation modes of cell 32 is based on an inclusion of each switch SW1-SWX1 and each LED within LED matrix L11-LXY. However, in practice, a cell design of a current-source driven switching LED cell based on cell 32 can include any number and any arrangement of switches SW11-SWX1 and LEDs of LED matrix L11-LXY as would be appreciated by those having ordinary skill in the art.

In a radiating mode of cell 32 as illustrated in FIG. 5, switches SW11-SWX1 are opened whereby current $i_{PM1}$ can sequentially flow through an input terminal IN3, LED matrix L11-LXY and an output terminal OUT3 to thereby radiate a color of light in dependence upon the selected color(s) of the LEDs. In a disabled mode as illustrated in FIG. 6, selected switches SW11-SWX1 are closed to thereby impede a flow of current $i_{PM1}$ through LED matrix L11-LXY whereby the LEDs do not radiate the color of light. Again, current $i_{PM1}$ constitutes a pulse modulated current due to the complementary opening and closing of switches SW11-SWX1 at a LED driving frequency (e.g., 200 Hz), which can be accomplished by conventional techniques as would occur to those skilled in the art. In alternative operating embodiments of cell 32, switches SW11-SWX1 can be individually operated at different LED driving frequencies or operated in groups at different LED driving frequencies. In such a case, current $i_{PM1}$ may consist of multiple pulse modulated currents at various LED driving frequencies.

Embodiments of switching LED cell 32 can further include one or more additional switches (e.g., semiconductor switches) distributed throughout the selected LEDs whereby a color level and/or a color intensity can be varied in dependence on an opening and a closing of the additional switches relative to the opening and closing of switches SW11-SWX1 as illustrated in FIGS. 5 and 6. Such multiple LED embodiments may operate switches SW11-SWX1 as well as the additional switches at the same or different LED driving frequencies. Current $i_{PM1}$ may consist of multiple pulse modulated currents at various LED driving frequencies in embodiments where the additional switches are individually operated at different LED driving frequencies or are operated in multiple groups at different LED driving frequencies.

Referring to FIGS. 1-6, the number and arrangements of a current source LED driver of the present invention employing a current source and one of the current source driven switching LED cells 30-32 are without limit. FIGS. 7-11 illustrate several exemplary embodiments of current source LED drivers of the present invention.

Figure 7:
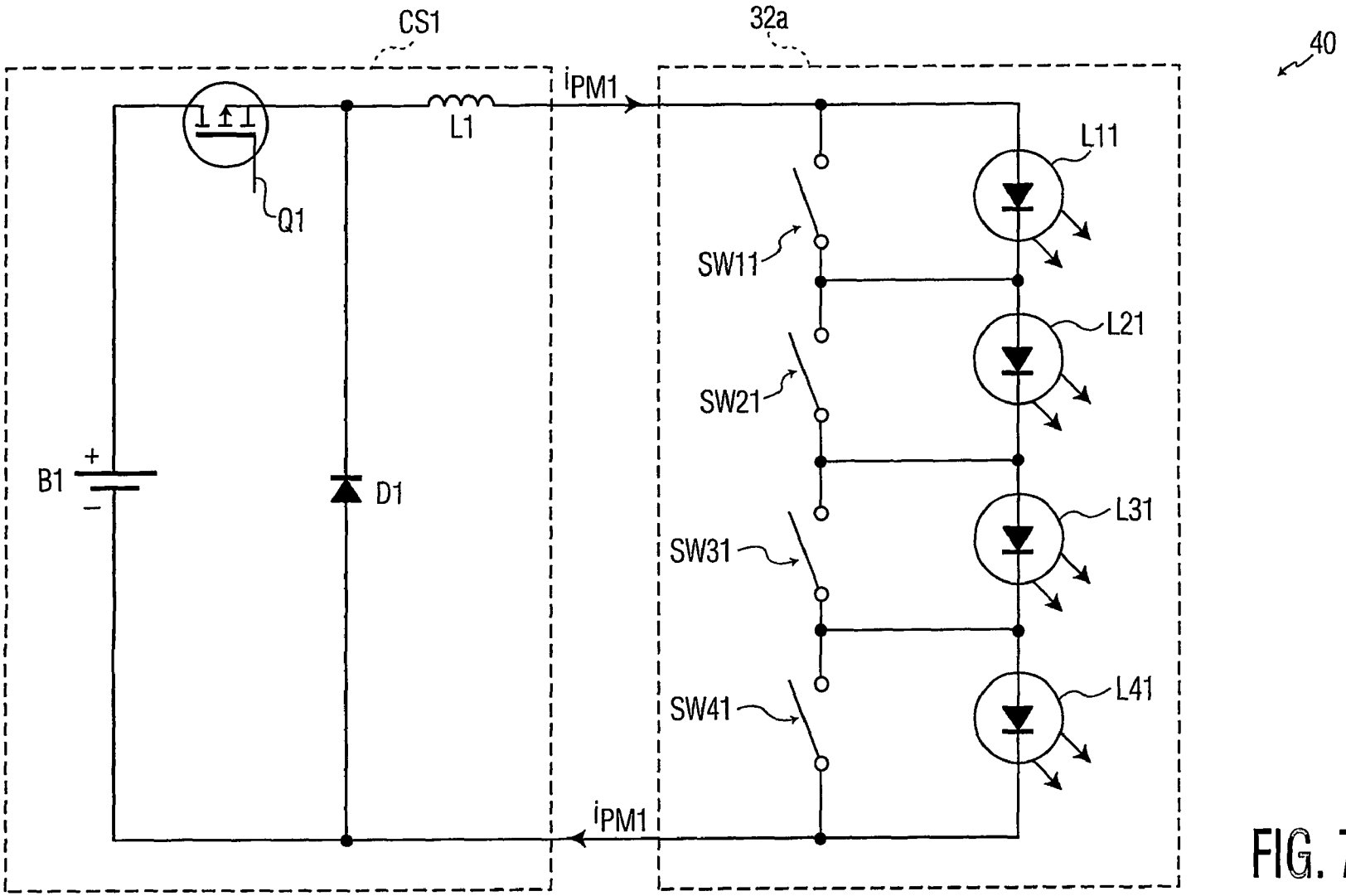
FIG. 7 illustrates a schematic diagram of a first embodiment in accordance with the present invention of a current source LED driver circuit employing a single current-driven switching LED cell.

FIG. 7 illustrates a current source LED driver 40 employing a current source CS1 in the form of a Buck converter having a known arrangement of a battery B1, a semiconductor switch Q1, a diode D1 and an inductor L1. Current source CS1 is conventionally operated by an application of a gate signal to a gate of semiconductor switch Q1 at a power conversion frequency (e.g., 100 KHz) as would occur to those having ordinary skill in the art.

Figure 8:
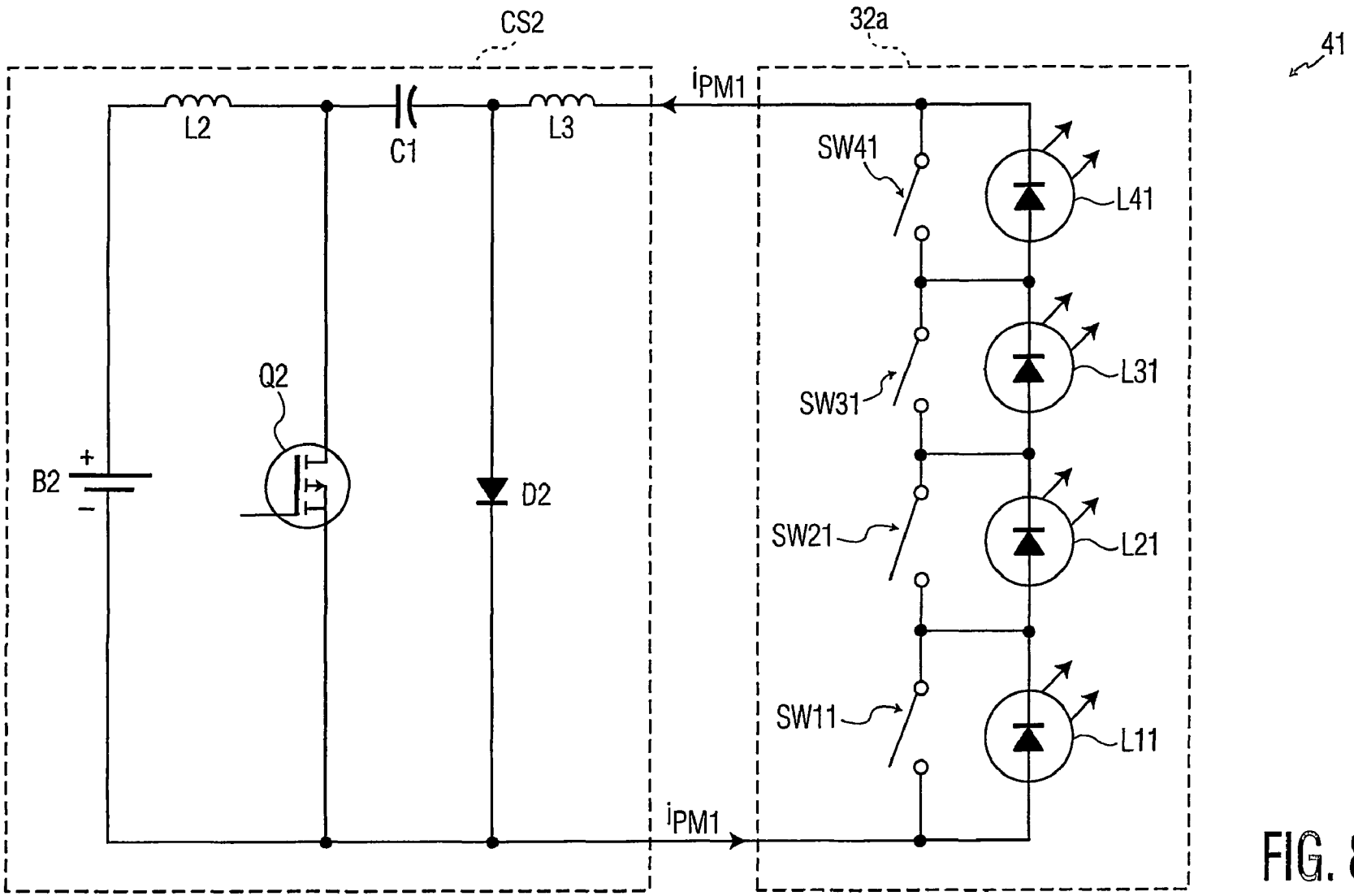
FIG. 8 illustrates a schematic diagram of a second embodiment in accordance with the present invention of a current source LED driver circuit employing a single current-driven switching LED cell.

FIG. 8 illustrates a current source LED driver 41 employing a current source CS2 in the form of a Cuk converter having a known arrangement of a battery B2, an inductor L2, a semiconductor switch Q2, a capacitor C1, a diode D2 and an inductor L3. Current source CS2 is conventionally operated by an application of a gate signal to a gate of semiconductor switch Q2 at a power conversion frequency (e.g., 100 KHz) as would occur to those having ordinary skill in the art.

Figure 9:
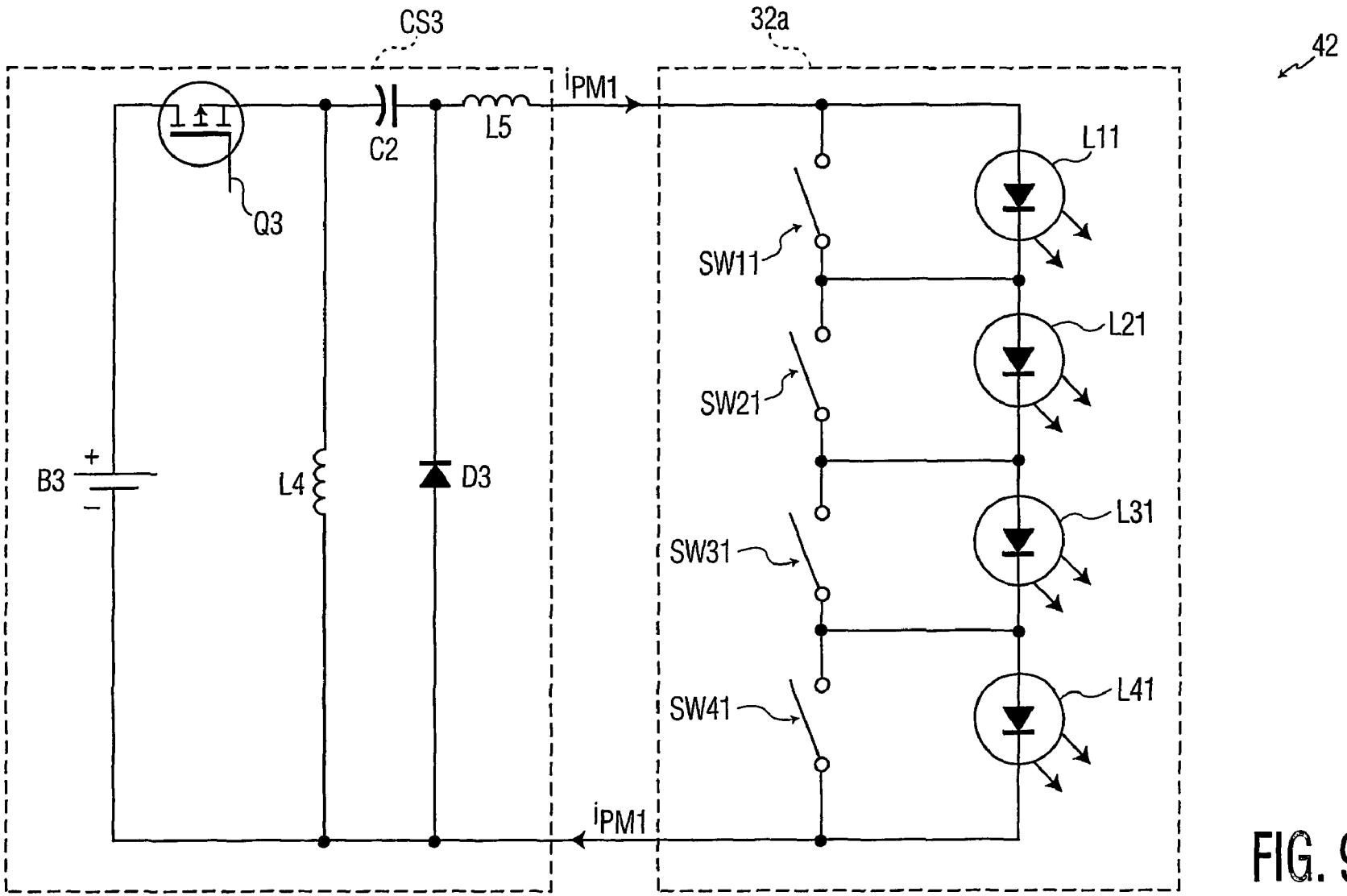
FIG. 9 illustrates a schematic diagram of a third embodiment in accordance with the present invention of a current source LED driver circuit employing a single current-driven switching LED cell.

FIG. 9 illustrates a current source LED driver 42 employing a current source CS3 in the form of a Zeta converter having a known arrangement of a battery B3, a semiconductor switch Q3, an inductor L4, a capacitor C2, a diode D3 and an inductor L5. Current source CS3 is conventionally operated by an application of a gate signal to a gate of semiconductor switch Q3 at a power conversion frequency (e.g., 100 KHz) as would occur to those having ordinary skill in the art.

Figure 10:
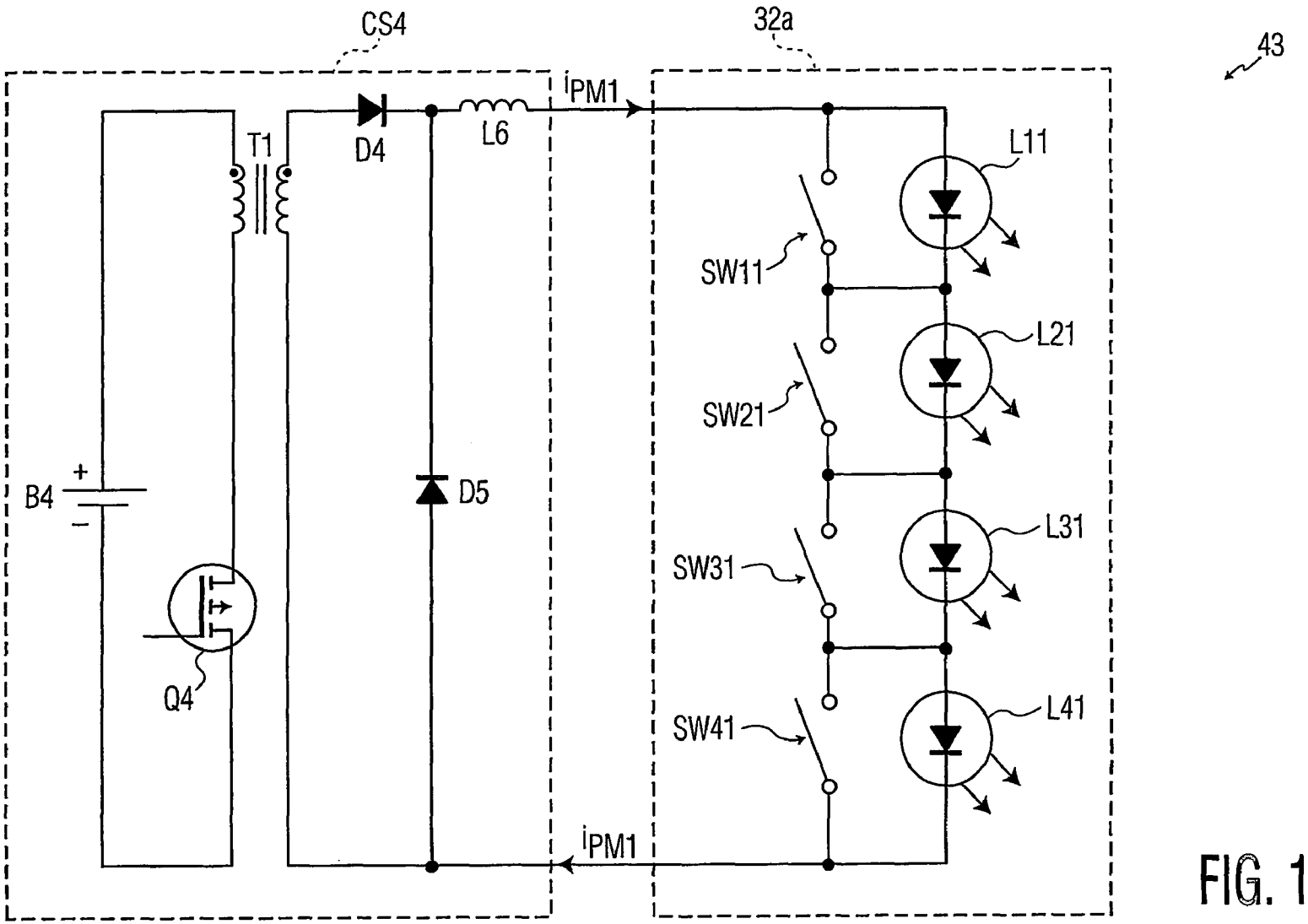
FIG. 10 illustrates a schematic diagram of a fourth embodiment in accordance with the present invention of a current source LED driver circuit employing a single current-driven switching LED cell.

FIG. 10 illustrates a current source LED driver 43 employing a current source CS4 in the form of a Forward converter having a known arrangement of a battery B4, a transformer T1, a semiconductor switch Q4, a diode D4, a diode D5 and an inductor L6. Driver 43 further employs version 32*a* of cell 32 (FIGS. 5 and 6). Current source CS4 is conventionally operated by an application of a gate signal to a gate of semiconductor switch Q4 at a power conversion frequency (e.g., 100 KHz) as would occur to those having ordinary skill in the art.

Referring to FIGS. 7-10, drivers 40-43 further employ a version 32*a* of cell 32 (FIGS. 3 and 4) having an illustrated circuit arrangement of switches SW11-SW41 and LEDs L11-L41. LED L11, LED L21, LED L31 and/or LED L41 can be implemented as a plurality of LEDs in any desired circuit arrangement that may include additional switches. In one embodiment, LED L11 consists of one or more red LEDs, LED L21 consists of green LEDs, LED L31 consists of blue LEDs, and LED L41 consists of one or more amber LEDs.

Cell 32*a* has fifteen (15) radiating modes with each radiating mode of cell 32*a* involving a selective opening of one or more of the switches SW11-SW41 whereby current $i_{PM1}$ flows through one or more of the LEDs L11-L41 to thereby radiate a color of light in dependence upon which LEDs L11-L41 are radiating light. In a disabled mode of cell 32*a*, switches SW11-SW41 are closed to thereby impede a flow of current $i_{PM1}$ through the LEDs L11-L41 whereby LEDs L11-L41 do not radiate the color of light. Cell 32*a* switches between one of the radiating modes and the disabled mode at a LED driving frequency (e.g., 200 Hz) in dependence upon conventional control signals selectively applied to switches SW11-SW41. In alternative operating embodiments of cell 32*a*, switches SW11-SW41 can be individually operated at different LED driving frequencies or operated in groups at different LED driving frequencies. In such a case, current $i_{PM1}$ may consist of multiple pulse modulated currents at various LED driving frequencies.

Figure 11:
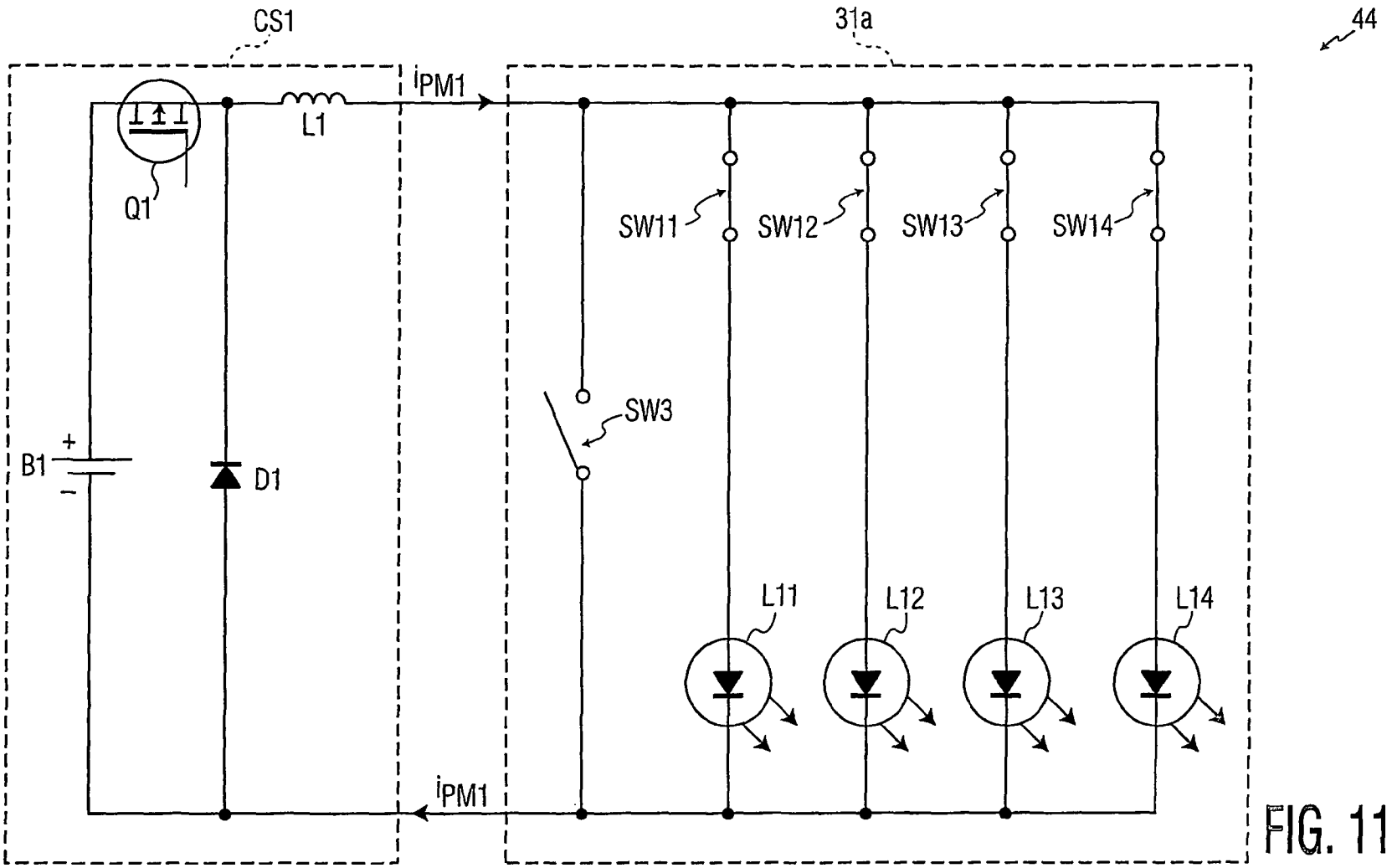
FIG. 11 illustrates a schematic diagram of a fifth embodiment in accordance with the present invention of a current source LED driver circuit employing a single current-driven switching LED cell.

FIG. 11 illustrates a current source LED driver 44 employing current source CS1 (FIG. 7) and a version 31*a* of cell 31 (FIGS. 3 and 4) having an illustrated circuit arrangement of switch SW3, switches SW11-SW14 and LEDs L11-L14. LED L11, LED L12, LED L13 and/or LED L14 can be implemented as a plurality of LEDs in any desired circuit arrangement that may include additional switches. In one embodiment, LED L11 consists of one or more red LEDs, LED L12 consists of green LEDs, LED L13 consists of blue LEDs, and LED L14 consists of one or more amber LEDs.

Cell 31*a* has fifteen (15) radiating modes with each radiating mode of cell 31*a* involving an opening of switch SW3 and a selective closing of one or more of the switches SW11-SW14 whereby current $i_{PM1}$ flows through one or more of the LEDs L11-L14 to thereby radiate a color of light in dependence upon which LEDs L11-L14 are radiating light. In a disabled mode of cell 31*a*, switch SW3 and switches SW11-SW14 are closed to thereby impede a flow of current $i_{PM1}$ through the LEDs L11-L14 whereby LEDs L11-L14 do not radiate the color of light. Cell 31*a* switches between one of the radiating modes and the disabled mode at a LED driving frequency (e.g., 200 Hz) in dependence upon conventional control signals selectively applied to switches SW11-SW14. In alternative operating embodiments of cell 31*a*, switches SW11-SW14 can be individually operated at different LED driving frequencies or operated in groups at different LED driving frequencies. In such a case, current $i_{PM1}$ may consist of multiple pulse modulated currents at various LED driving frequencies.

Figure 12:
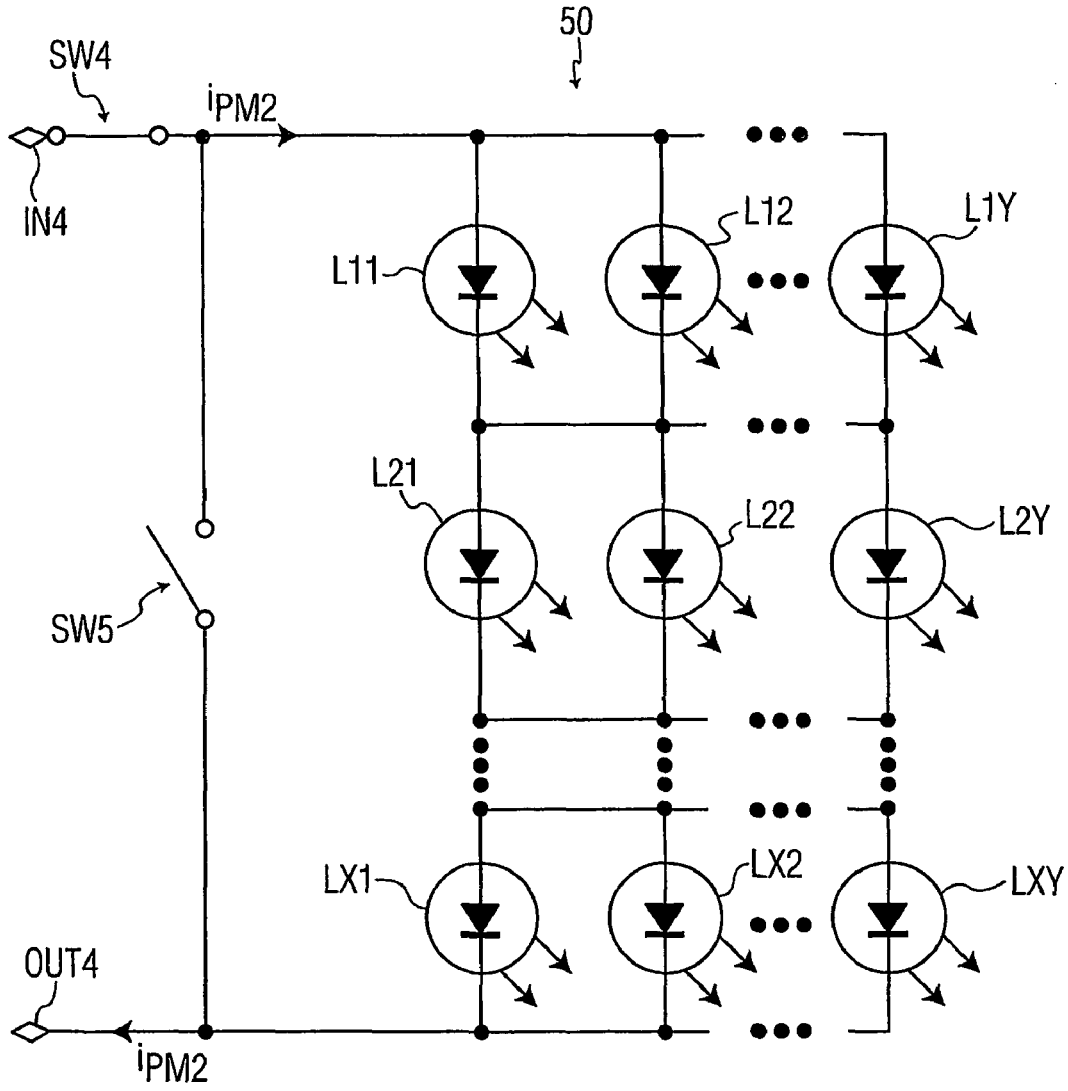
FIGS. 12 and 13 illustrate a schematic diagram of a first baseline embodiment in accordance with the present invention of a voltage-source driven switching LED cell.
Figure 13:
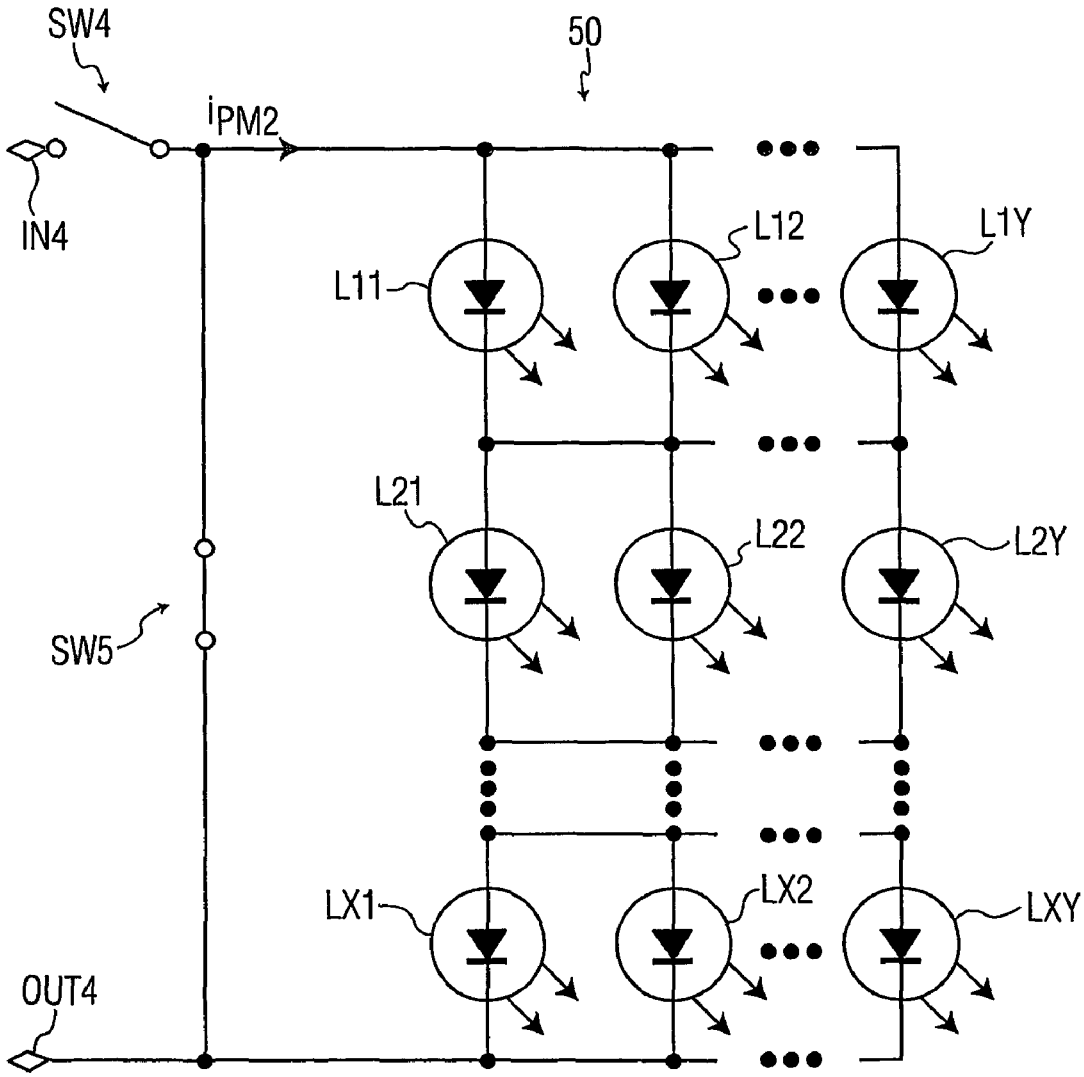

FIGS. 12 and 13 illustrate a baseline voltage-source driven switching LED cell 50 further employing a switch SW5 (e.g., a semiconductor switch) connected in parallel to LED matrix L11-LXY, and a switch SW4 (e.g., a semiconductor switch) connected in series to the parallel connection of switch SW5 and LED matrix L11-LXY. To facilitate an understanding of cell 50, the following description of the operation modes of cell 50 is based on an inclusion of each LED within LED matrix L11-LXY. However, in practice, a cell design of a voltage-source driven switching LED cell based on cell 50 can include any number and any arrangement of LEDs from LED matrix L11-LXY as would be appreciated by those having ordinary skill in the art.

In a radiating mode of cell 50 as illustrated in FIG. 12, switch SW4 is closed and switch SW5 is opened whereby a current $i_{PM1}$ can sequentially flow through an input terminal IN4, switch SW4, LED matrix L11-LXY, and an output terminal OUT4 to thereby radiate a color of light in dependence upon the selected color(s) of the LEDs. In a disabled mode of cell 50 as illustrated in FIG. 13, switch SW4 is opened and switch SW5 is closed to thereby impede a flow of current $i_{PM1}$ through LED matrix L11-LXY whereby the LEDs do not radiate the color of light. Current $i_{PM1}$ constitutes a pulse modulated current due to the complementary opening and closing of switches SW4 and SW5 at a LED driving frequency (e.g., 200 Hz), which can be accomplished by conventional techniques as would occur to those having ordinary skill in the art.

Multiple LED embodiments of switching LED cell 50 can further include one or more additional switches (e.g., semiconductor switches) distributed throughout the LEDs of LED matrix L11-LXY whereby a color level and/or a color intensity of the light radiated by the LEDs can be varied in dependence on an opening and a closing of the additional switches relative to the opening and closing of switches SW4 and SW5 as illustrated in FIGS. 12 and 13. Such multiple LED embodiments may operate switches SW4 and SW5 as well as the additional switches at the same or different LED driving frequencies. Current $i_{PM2}$ may consist of multiple pulse modulated currents at various LED driving frequencies in embodiments where the additional switches are individually operated at different LED driving frequencies or are operated in multiple groups at different LED driving frequencies.

Figure 14:
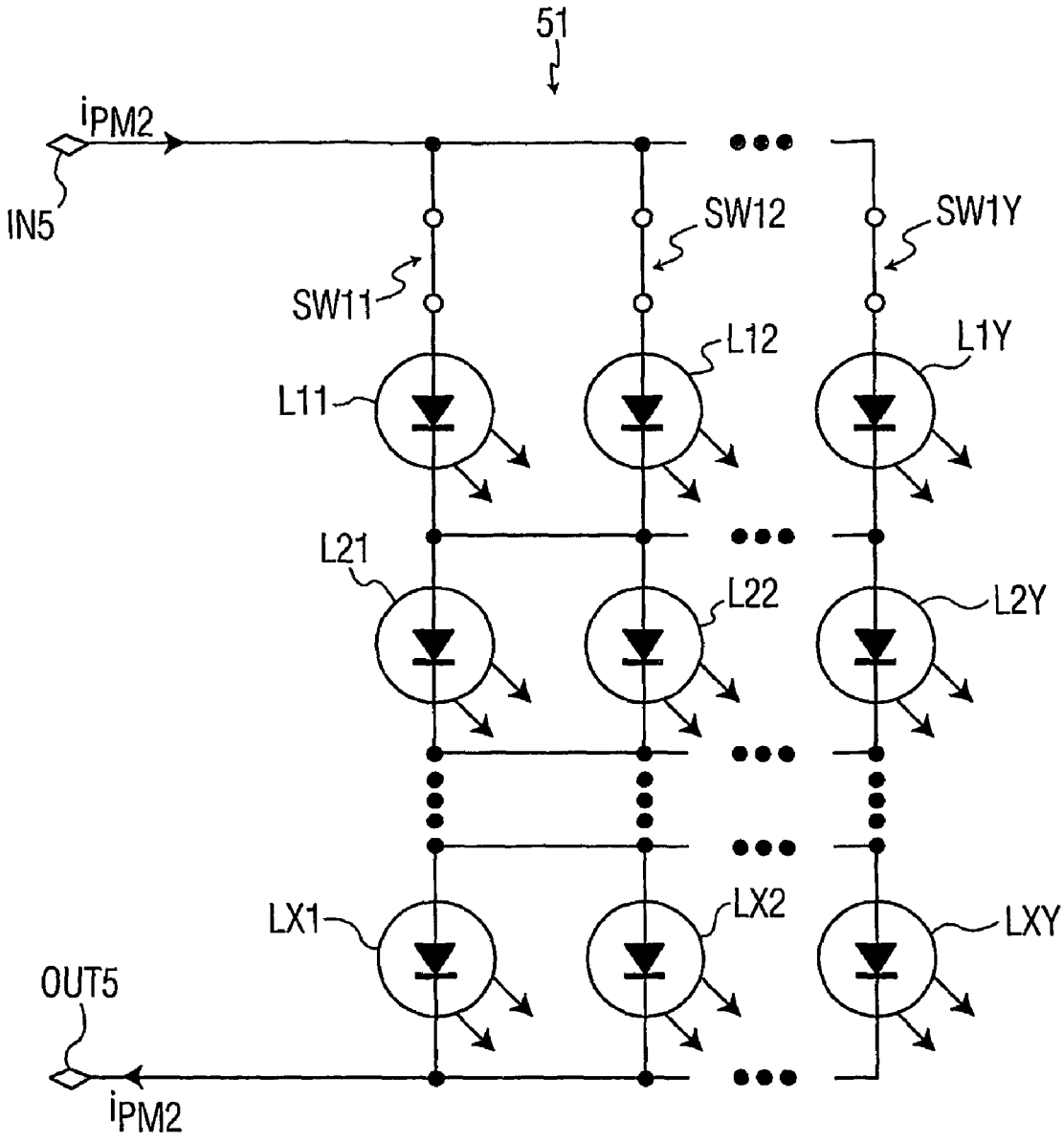
FIGS. 14 and 15 illustrate a schematic diagram of a second baseline embodiment in accordance with the present invention of a voltage-source driven switching LED cell.
Figure 15:
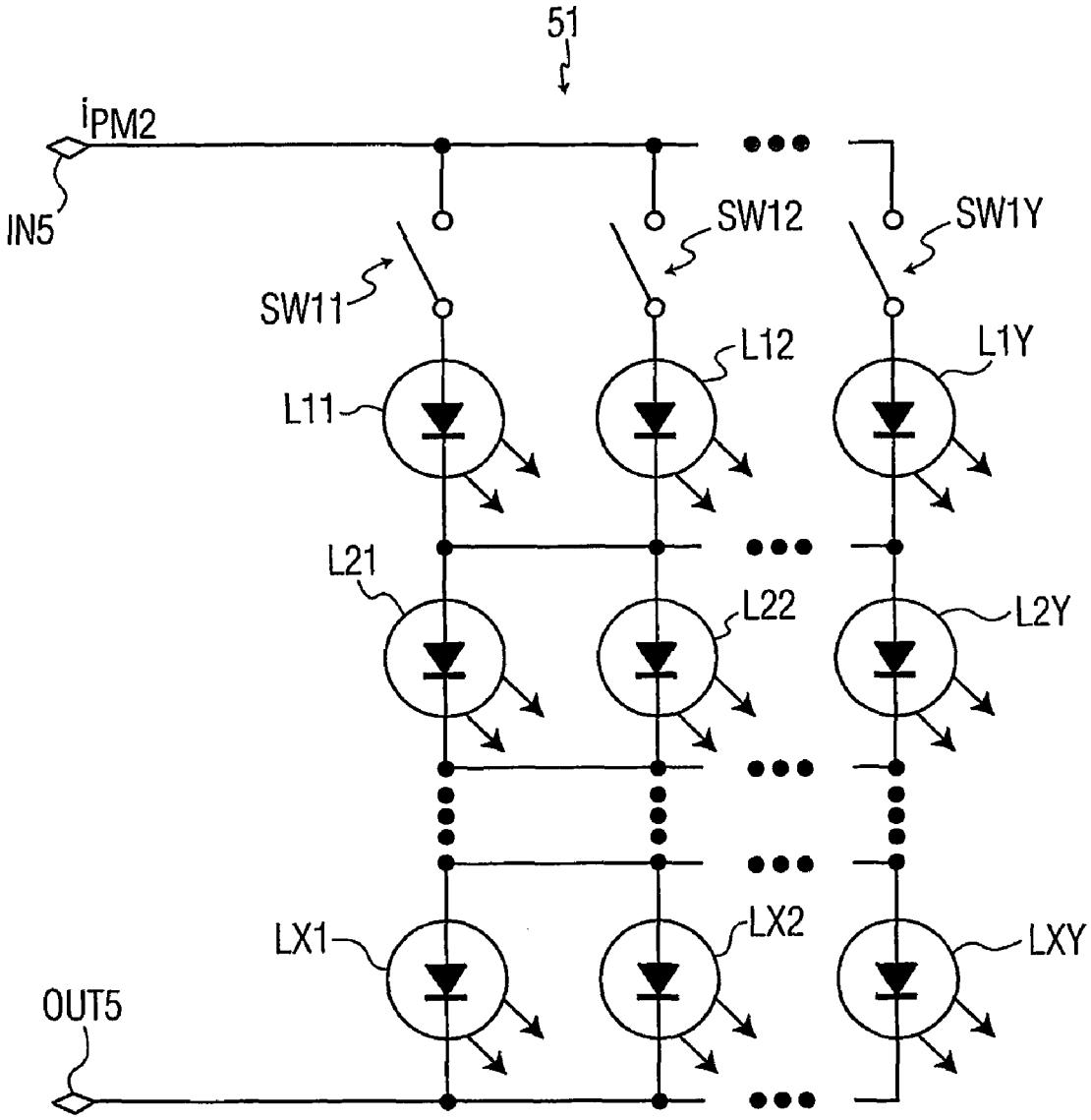

FIGS. 14 and 15 illustrate a baseline voltage-source driven switching LED cell 51 employing a circuit arrangement of switches SW11-SW1Y (e.g., semiconductor switches) connected to LED matrix L11-LXY. To facilitate an understanding of cell 51, the following description of the operation modes of cell 51 is based on an inclusion of each switch SW1-SW1Y and each LED within LED matrix L11-LXY. However, in practice, a cell design of a voltage-source driven switching LED cell based on cell 51 can include any number and any arrangement of switches SW11-SW1Y and LEDs of LED matrix L11-LXY as would be appreciated by those having ordinary skill in the art.

In a radiating mode of cell 51 as illustrated in FIG. 14, switches SW11-SW1Y are closed whereby current $i_{PM1}$ can sequentially flow through an input terminal IN5, switches SW11-SW1Y, LED matrix L11-LXY and an output terminal OUT5 to thereby radiate a color of light in dependence upon the selected color(s) of the LEDs. In a disabled mode of cell 51 as illustrated in FIG. 15, switches SW11-SW1Y are opened to thereby impede a flow of current $i_{PM1}$ through LED matrix L11-LXY whereby the LEDs do not radiate the color of light. Again, current $i_{PM1}$ constitutes a pulse modulated current due to the opening and closing of switches SW11-SW1Y at a LED driving frequency (e.g., 200 Hz), which can be accomplished by conventional techniques as would occur to those skilled in the art. In alternative operating embodiments of cell 51, switches SW11-SW1Y can be individually operated at different LED driving frequencies or operated in groups at different LED driving frequencies. In such a case, current $i_{PM2}$ may consist of multiple pulse modulated currents at various LED driving frequencies.

Embodiments of switching LED cell 51 can further include one or more additional switches (e.g., semiconductor switches) distributed throughout the LED matrix L11-LXY whereby a color level and/or a color intensity can be varied in dependence on an opening and a closing of the additional switches relative to the opening and closing of switches SW11-SW1Y as illustrated in FIGS. 14 and 15. Such multiple LED embodiments may operate switches SW11-SW1Y as well as the additional switches at the same or different LED driving frequencies. Current $i_{PM2}$ may consist of multiple pulse modulated currents at various LED driving frequencies in embodiments where the additional switches are individually operated at different LED driving frequencies or are operated in multiple groups at different LED driving frequencies.

Figure 16:
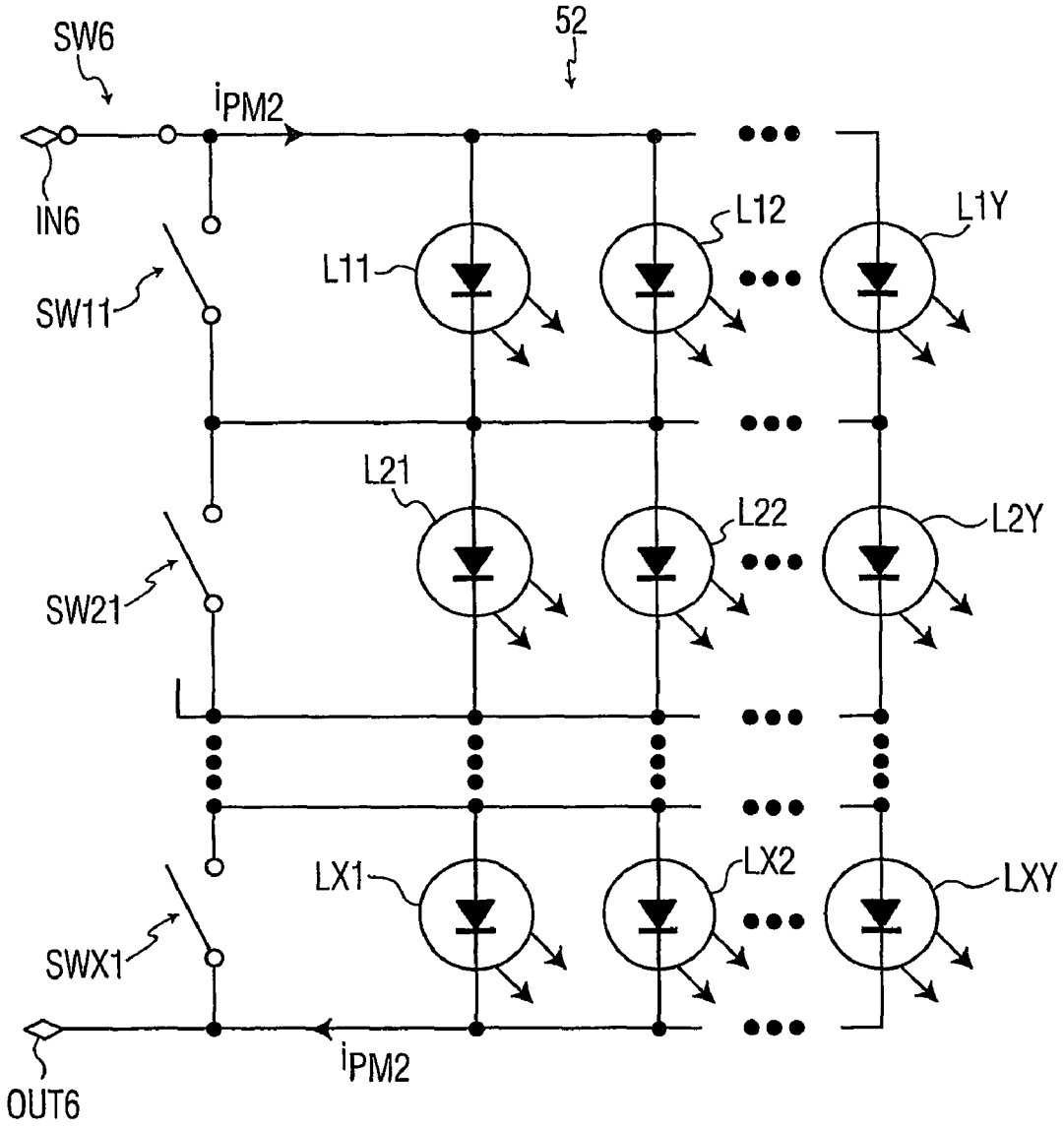
FIGS. 16 and 17 illustrate a schematic diagram of a third baseline embodiment in accordance with the present invention of a voltage-source driven switching LED cell.
Figure 17:
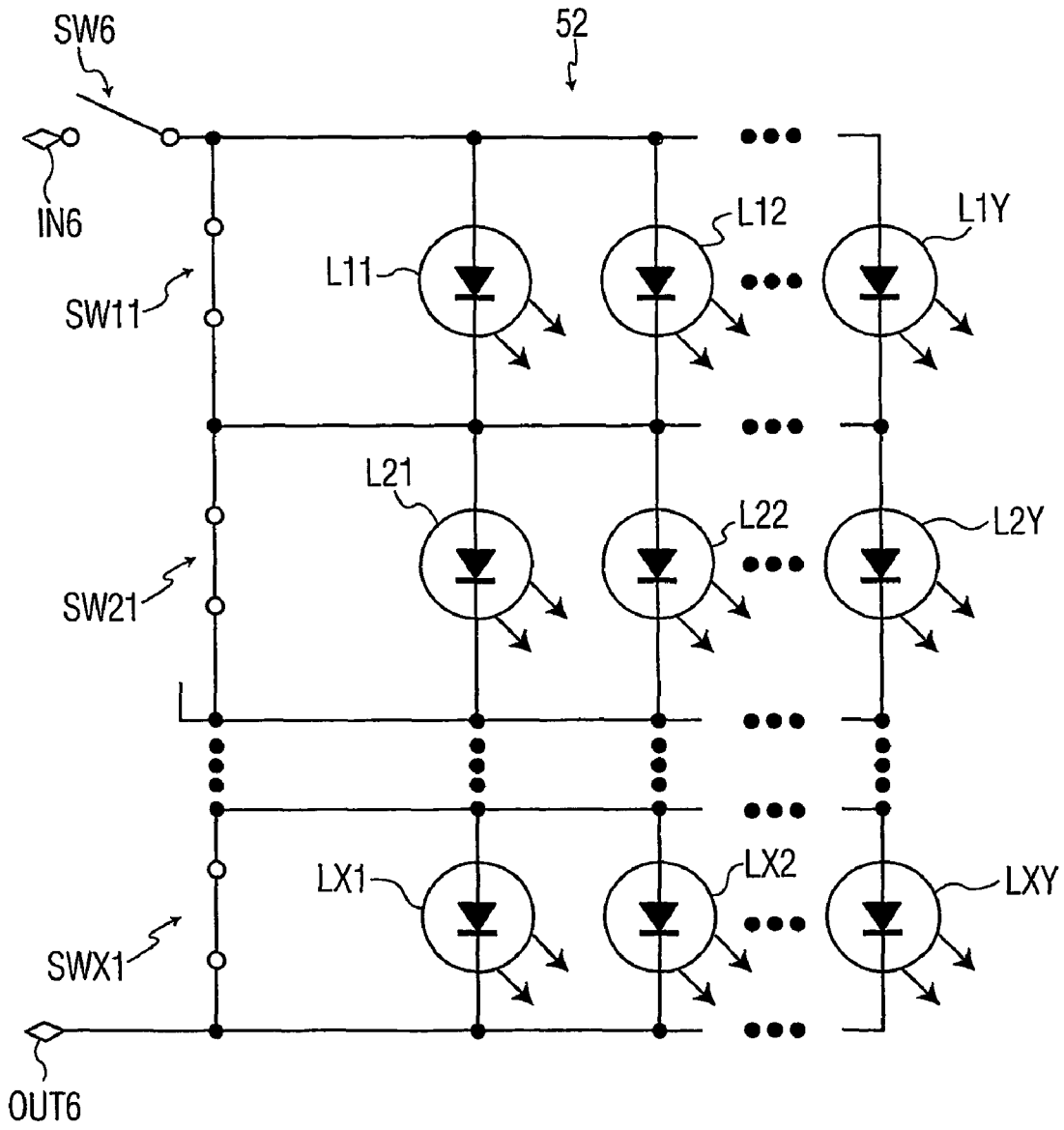

FIGS. 16 and 17 illustrate a baseline voltage-source driven switching LED cell 52 employing a circuit arrangement of switches SW11-SWX1 (e.g., semiconductor switches) connected to the LED matrix L11-LXY. Cell 52 further employs a switch SW6 (e.g., a semiconductor switch) connected in series to the circuit arrangement of switches SW11-SWX1 and LED matrix L11-LXY. To facilitate an understanding of cell 52, the following description of the operation modes of cell 52 is based on an inclusion of each switch SW1-SWX1 and each LED within LED matrix L11-LXY. However, in practice, a cell design of a voltage-source driven switching LED cell based on cell 52 can include any number and any arrangement of switches SW11-SWX1 and LEDs of LED matrix L11-LXY as would be appreciated by those having ordinary skill in the art.

In a radiating mode of cell 52 as illustrated in FIG. 16, switch SW6 is closed and switches SW11-SWX1 are opened whereby current $i_{PM1}$ can sequentially flow through an input terminal IN6, LED matrix L11-LXY and an output terminal OUT6 to thereby radiate a color of light in dependence upon the selected color(s) of the LEDs. In a disabled mode as illustrated in FIG. 17, selected switches SW11-SWX1 are closed to thereby impede a flow of current $i_{PM1}$ through LED matrix L11-LXY whereby the LEDs do not radiate the color of light. Again, current $i_{PM1}$ constitutes a pulse modulated current due to the complementary opening and closing of switch SW6 and switches SW11-SWX1 at a LED driving frequency (e.g., 200 Hz), which can be accomplished by conventional techniques as would occur to those skilled in the art. In alternative operating embodiments of cell 52, switches SW11-SW1Y can be individually operated at different LED driving frequencies or operated in groups at different LED driving frequencies. In such a case, current $i_{PM2}$ may consist of multiple pulse modulated currents at various LED driving frequencies.

Embodiments of switching LED cell 52 can further include one or more additional switches (e.g., semiconductor switches) distributed throughout the selected LEDs whereby a color level and/or a color intensity can be varied in dependence on an opening and a closing of the additional switches relative to the opening and closing of switch SW6 and switches SW11-SWX1 as illustrated in FIGS. 16 and 17. Such multiple LED embodiments may operate switch SW6 and switches SW11-SWX1 as well as the additional switches at the same or different LED driving frequencies. Current $i_{PM2}$ may consist of multiple pulse modulated currents at various LED driving frequencies in embodiments where the additional switches are individually operated at different LED driving frequencies or are operated in multiple groups at different LED driving frequencies.

Figure 18:
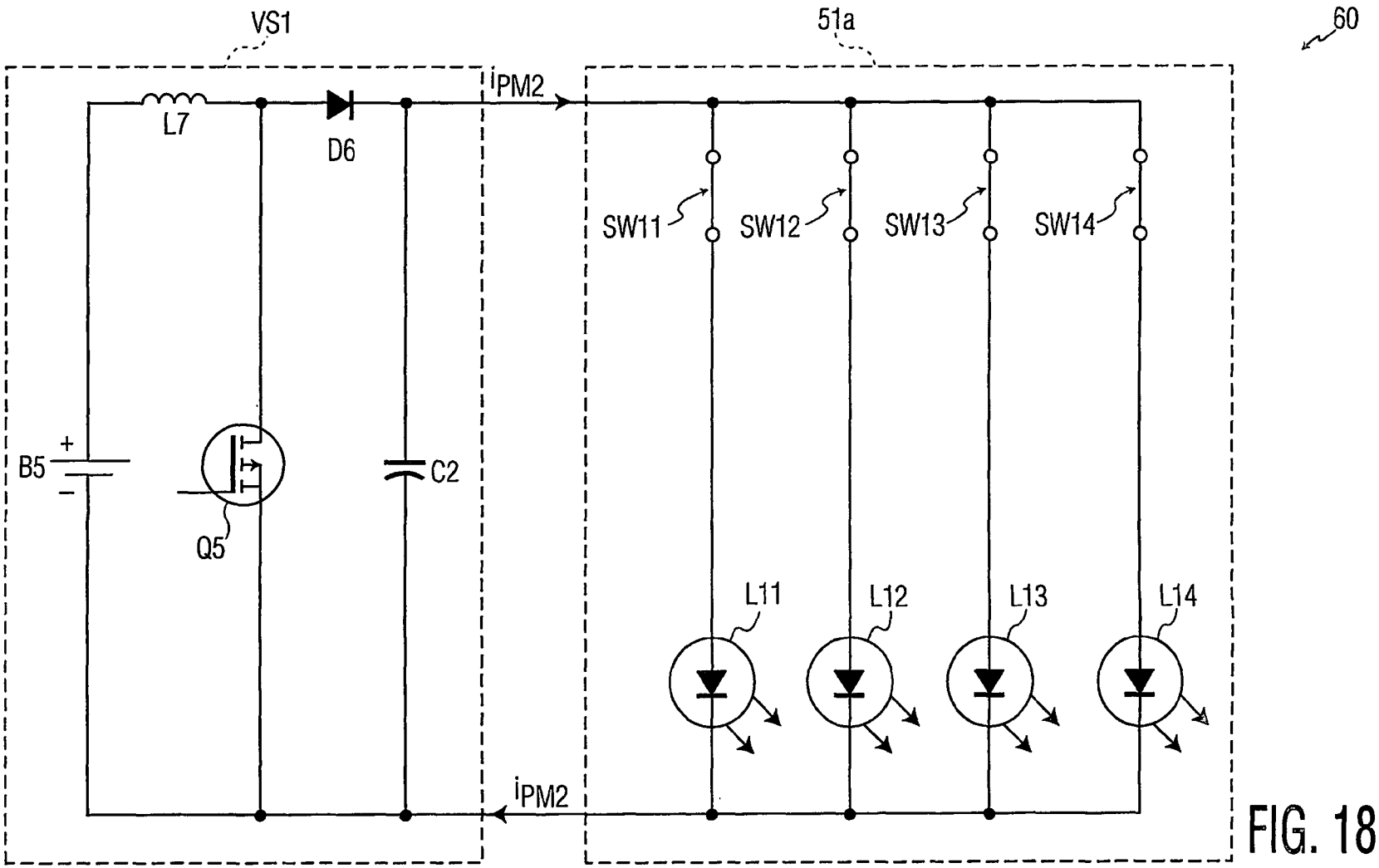
FIG. 18 illustrates a schematic diagram of a first embodiment in accordance with the present invention of a voltage source LED driver circuit employing a single voltage-driven switching LED cell.
Figure 19:
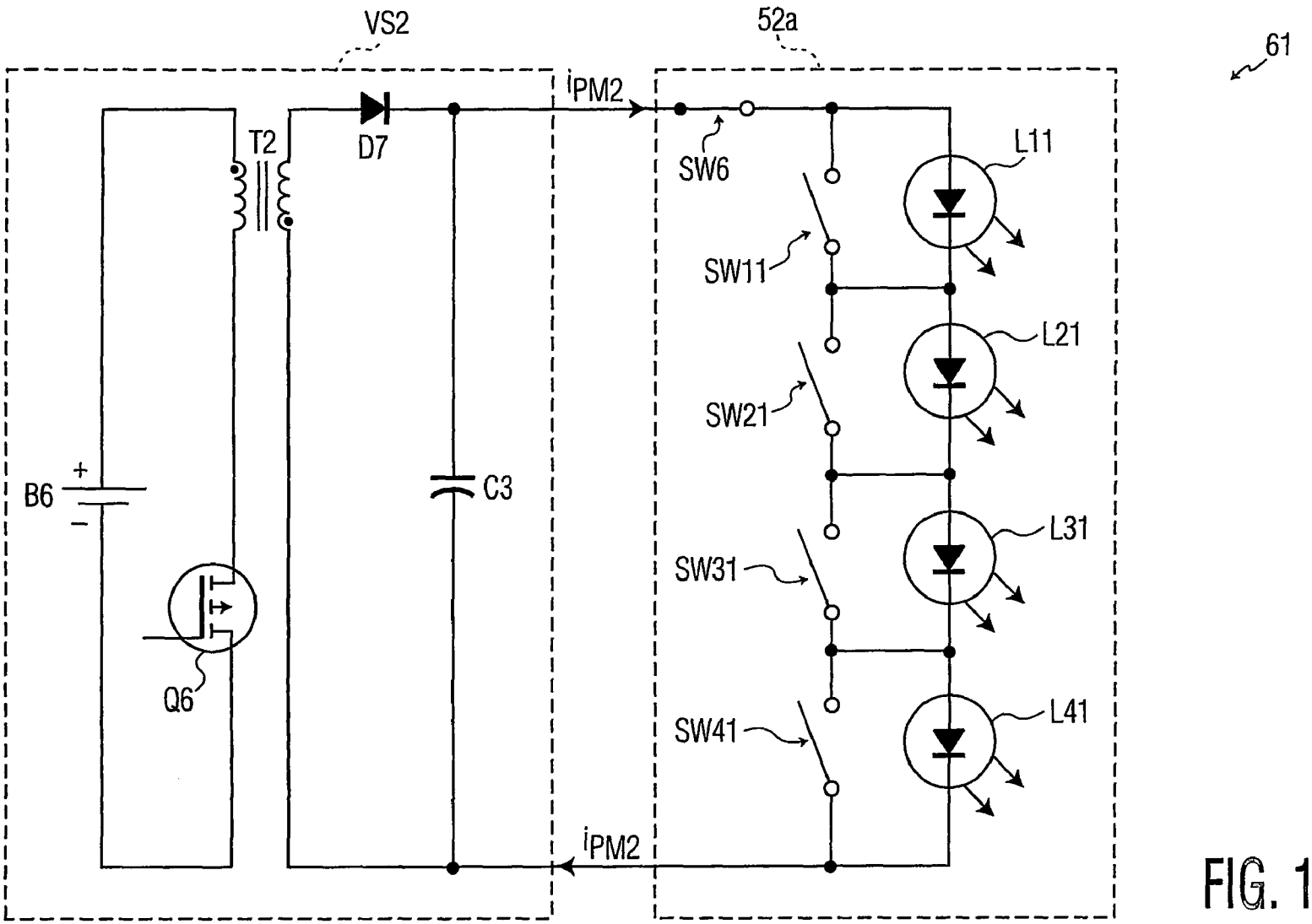
FIG. 19 illustrates a schematic diagram of a second embodiment in accordance with the present invention of a voltage source LED driver circuit employing a single voltage-driven switching LED cell.

Referring to FIGS. 12-17, the number and arrangements of a voltage source LED driver of the present invention employing a voltage source and one of the voltage source driven switching LED cells 50-52 are without limit. FIGS. 18 and 19 illustrate several exemplary embodiments of voltage source LED drivers of the present invention.

FIG. 18 illustrates a voltage source LED driver 60 employing a voltage source VS1 in the form of a Boost converter having a known arrangement of a battery B5, an inductor L7, a semiconductor switch Q5, a diode D6 and a capacitor C2. Voltage source VS1 is conventionally operated by an application of a gate signal to a gate of switch Q5 at a power conversion frequency (e.g., 100 KHz) as would occur to those having ordinary skill in the art.

Driver 60 further employs a version 51*a* of cell 51 (FIGS. 13 and 14) having an illustrated circuit arrangement of switches SW11-SW14 and LEDs L11-L14. LED L11, LED L12, LED L13 and/or LED L14 can be implemented as a plurality of LEDs in any desired circuit arrangement that may include additional switches. In one embodiment, LED L11 consists of one or more red LEDs, LED L12 consists of green LEDs, LED L13 consists of blue LEDs, and LED L14 consists of one or more amber LEDs.

Cell 51*a* has fifteen (15) radiating modes with each radiating mode of cell 51*a* involving a selective opening of one or more of the switches SW11-SW14 whereby current $i_{PM1}$ flows through one or more of the LEDs L11-L14 to thereby radiate a color of light in dependence upon which LEDs L11-L14 are radiating light. In a disabled mode of cell 51*a*, switches SW11-SW14 are closed to thereby impede a flow of current $i_{PM1}$ through the LEDs L11-L14 whereby LEDs L11-L14 do not radiate the color of light. Cell 51*a* switches between one of the radiating modes and the disabled mode at a LED driving frequency (e.g., 200 Hz) in dependence upon conventional control signals selectively applied to switches SW11-SW14. In alternative operating embodiments of cell 51*a*, switches SW11-SW14 can be individually operated at different LED driving frequencies or operated in groups at different LED driving frequencies. In such a case, current $i_{PM2}$ may consist of multiple pulse modulated currents at various LED driving frequencies.

FIG. 19 illustrates a voltage source LED driver 61 employing a voltage source VS2 in the form of a Flyback converter having a known arrangement of a battery B6, a semiconductor switch Q6, a transformer T2, and a diode D7. Voltage source VS2 is conventionally operated by an application of a gate signal to a gate of switch Q6 at a power conversion frequency (e.g., 100 KHz) as would occur to those having ordinary skill in the art.

Driver 61 further employs a version 52*a* of cell 52 (FIGS. 16 and 17) having an illustrated circuit arrangement of switch SW6, switches SW11-SW41 and LEDs L11-L41. LED L11, LED L21, LED L31 and/or LED L41 can be implemented as a plurality of LEDs in any desired circuit arrangement that may include additional switches. In one embodiment, LED L11 consists of one or more red LEDs, LED L21 consists of green LEDs, LED L31 consists of blue LEDs, and LED L41 consists of one or more amber LEDs.

Cell 52*a* has fifteen (15) radiating modes with each radiating mode of cell 52*a* involving a closing of switch SW6 and a selective opening of one or more of the switches SW11-SW41 whereby current $i_{PM2}$ flows through one or more of the LEDs L11-L41 to thereby radiate a color of light in dependence upon which LEDs L11-L41 are radiating light. In a disabled mode of cell 52*a*, switch SW6 is opened and switches SW11-SW41 are closed to thereby impede a flow of current $i_{PM2}$ through the LEDs L11-L41 whereby LEDs L11-L41 do not radiate the color of light. Cell 52*a* switches between one of the radiating modes and the disabled mode at a LED driving frequency (e.g., 200 Hz) in dependence upon conventional control signals selectively applied to switches SW11-SW41. In alternative operating embodiments of cell 52*a*, switches SW11-SW41 can be individually operated at different LED driving frequencies or operated in groups at different LED driving frequencies. In such a case, current $i_{PM2}$ may consist of multiple pulse modulated currents at various LED driving frequencies.

Figure 20:
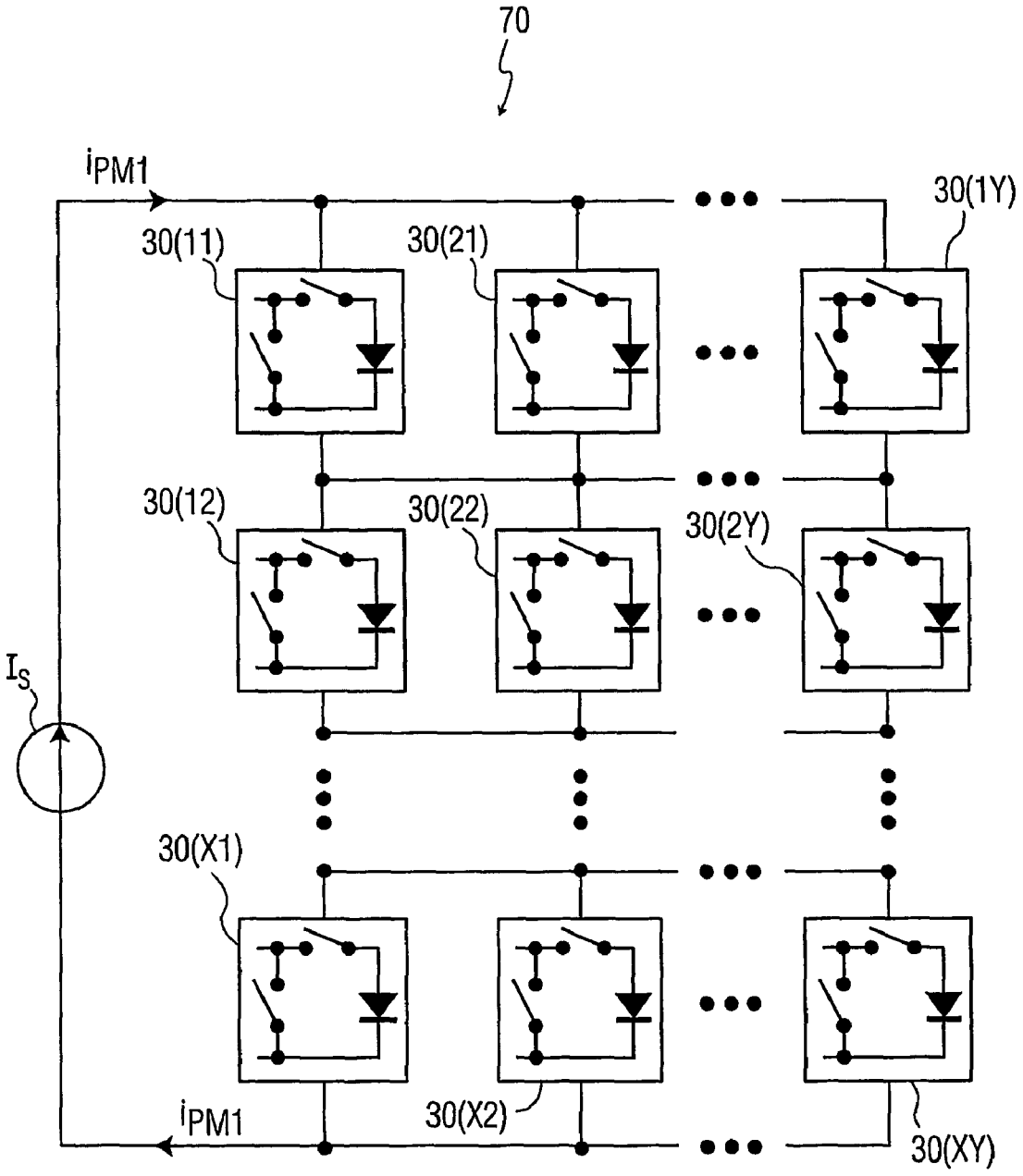
FIG. 20 illustrates a schematic diagram of a first baseline embodiment in accordance with the present invention of a current source LED driver circuit employing multiple current-driven switching LED cells.

FIG. 20 illustrates a baseline current source LED driver 70 employing a current source Is and a cell matrix 30(11)-30(XY) for designing one of numerous embodiments of a current source LED driver of the present invention. A driver design of a current source LED driver of the present invention involves (1) a selection of one or more current-source driven switching LED cells 30 within cell matrix 30(11)-30(XY), where X≧1 and Y≧1, (2) a LED design of each cell 30 selected from cell matrix 30(11)-30(XY), and (3) for multiple cell embodiments, a selection of one or more series connections and/or parallel connections of the multiple cells 30 selected from cell matrix 30(11)-30(XY). For driver embodiments employing multiple cells 30, the cells 30 having similar operating current specifications are preferably connected in series, and the cells 30 having similar operating voltage specifications are preferably connected in parallel. Those having ordinary skill in the art will appreciate that a driver design of a current source LED driver based on driver 70 of is without limit. FIGS. 22-25 illustrate several exemplary embodiment of current source LED drivers based on driver 70.

Figure 22:
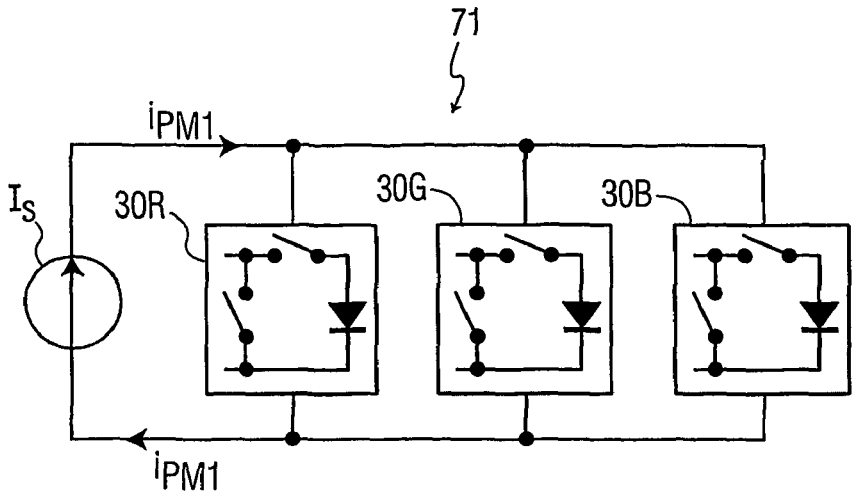
FIG. 22 illustrates a schematic diagram of a first embodiment in accordance with the present invention of the current source LED driver illustrated in FIG. 20.
Figure 23:
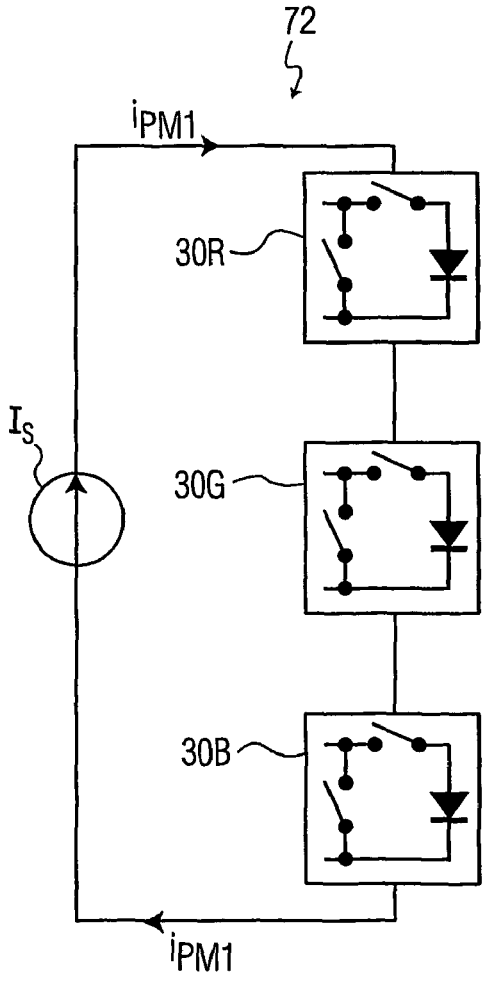
FIG. 23 illustrates a schematic diagram of a second embodiment in accordance with the present invention of the current source LED driver illustrated in FIG. 20.
Figure 24:
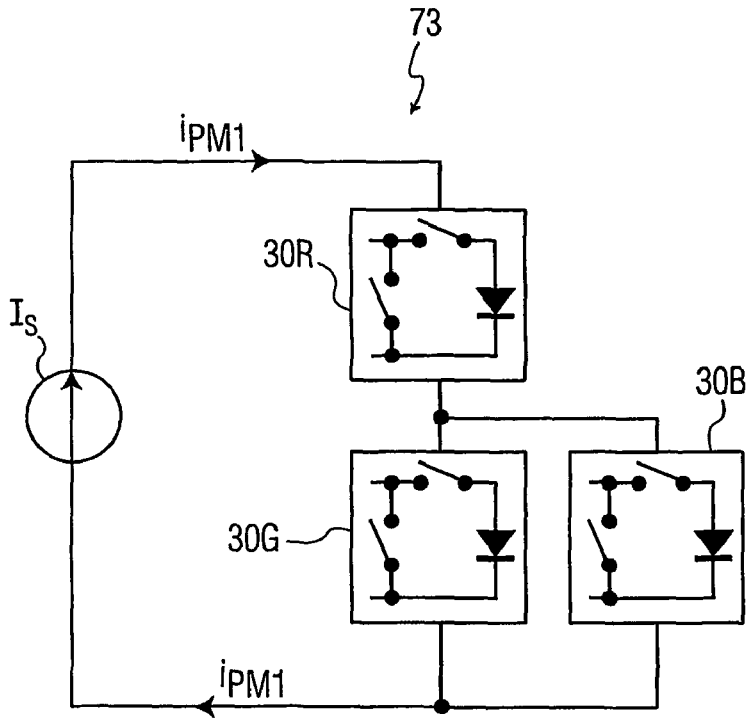
FIG. 24 illustrates a schematic diagram of a third embodiment in accordance with the present invention of the current source LED driver illustrated in FIG. 20.
Figure 25:
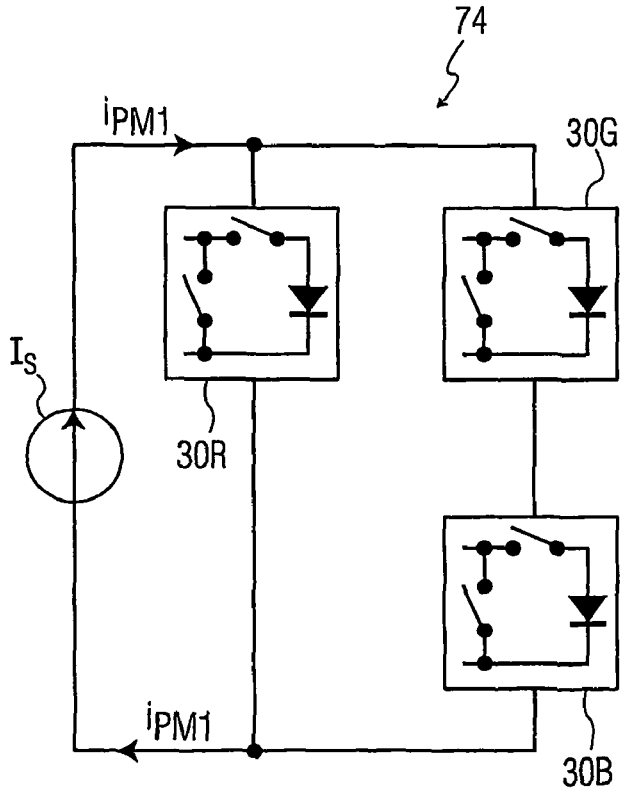
FIG. 25 illustrates a schematic diagram of a fourth embodiment in accordance with the present invention of the current source LED driver illustrated in FIG. 20.

FIG. 22 illustrates a red cell 30R, a green cell 30G, and a blue cell 30B connected in parallel to current source $I_S$. FIG. 23 illustrates red cell 30R, green cell 30G, and blue cell 30B connected in series to current source $I_S$. FIG. 24 illustrates red cell 30R connected in series current source $I_S$ and a parallel connection of green cell 30G and blue cell 30B. FIG. 25 illustrates red cell 30R and a series connection of green cell 30G and blue cell 30G connected in parallel to current source $I_S$. Referring to FIGS. 22-25, current source (e.g., CS1-CS4 illustrated in FIGS. 7-10) provides pulse modulate current $I_{PM1}$ to cells 30R, 30G and 30B in dependence upon the switching of each cell 30R, 30G and 30B between their respective radiating and disabled modes at the same LED driving frequency or at various LED driving frequencies where current $I_{PM1}$ may consist of multiple pulse modulated currents at various LED driving frequencies.

Figure 21:
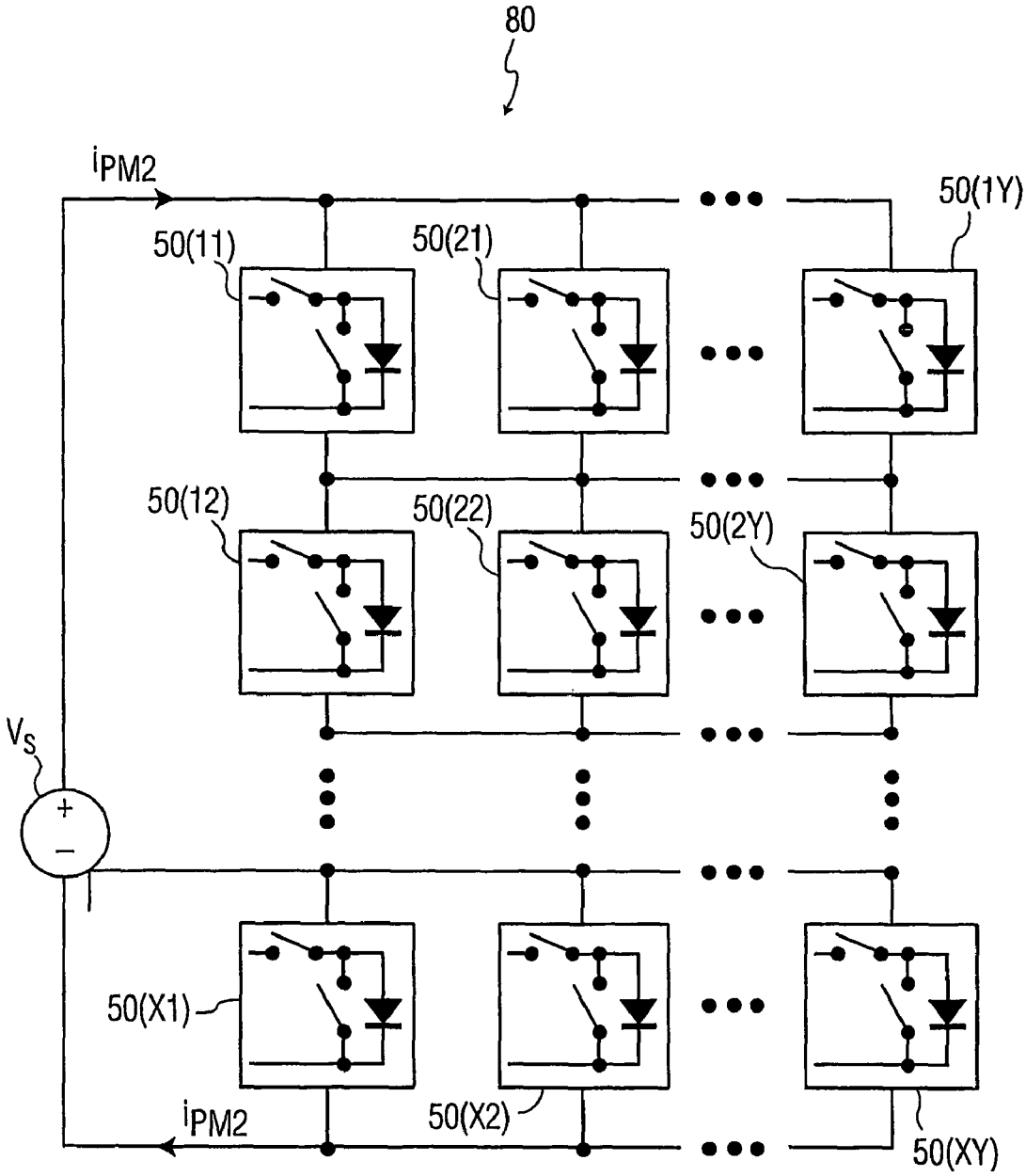
FIG. 21 illustrates a schematic diagram of a first baseline embodiment in accordance with the present invention of a voltage source LED driver circuit employing multiple voltage-driven switching LED cells.

FIG. 21 illustrates a baseline voltage source LED driver 80 employing a voltage source $V_S$ and a cell matrix 50(11)-50(XY) for designing one of numerous embodiments of a voltage source LED driver of the present invention. A driver design of a voltage source LED driver of the present invention involves (1) a selection of one or more voltage-source driven switching LED cells 50 within cell matrix 50(11)-50(XY), where X≧1 and Y≧1, (2) a LED design of each cell 50 selected from cell matrix 50(11)-50(XY), and (3) for multiple cell embodiments, a selection of one or more series connections and/or parallel connections of the multiple cells 50 selected from cell matrix 50(11)-50(XY). For driver embodiments employing multiple cells 50, the cells 50 having similar operating current specifications are preferably connected in series, and the cells 50 having similar operating voltage specifications are preferably connected in parallel. Those having ordinary skill in the art will appreciate that a driver design of a voltage source LED driver based on driver 80 of is without limit. FIGS. 26-29 illustrate several exemplary embodiment of voltage source LED drivers based on driver 80.

Figure 26:
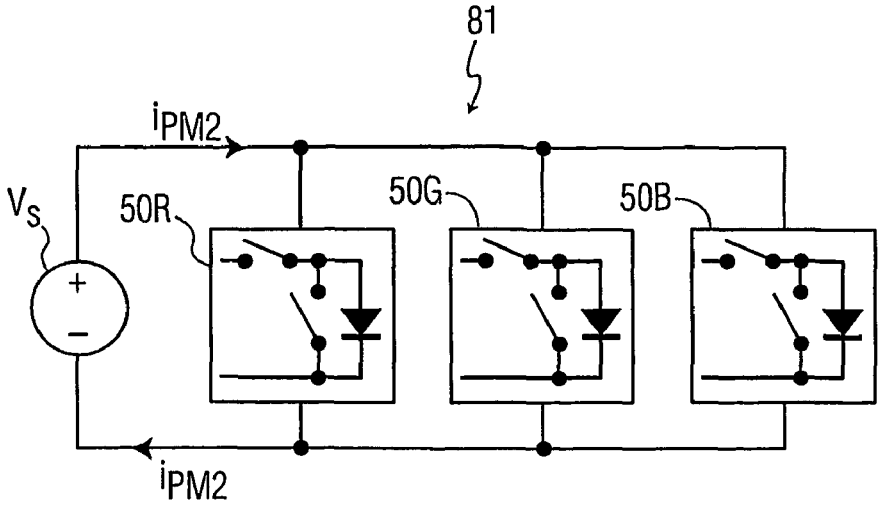
FIG. 26 illustrates a schematic diagram of a first embodiment in accordance with the present invention of the voltage source LED driver illustrated in FIG. 21.
Figure 27:
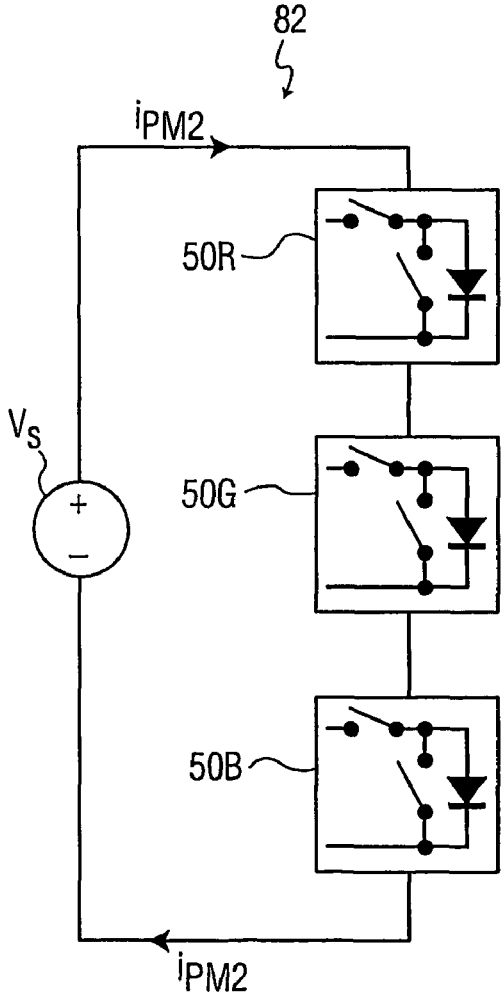
FIG. 27 illustrates a schematic diagram of a second embodiment in accordance with the present invention of the voltage source LED driver illustrated in FIG. 21.
Figure 28:
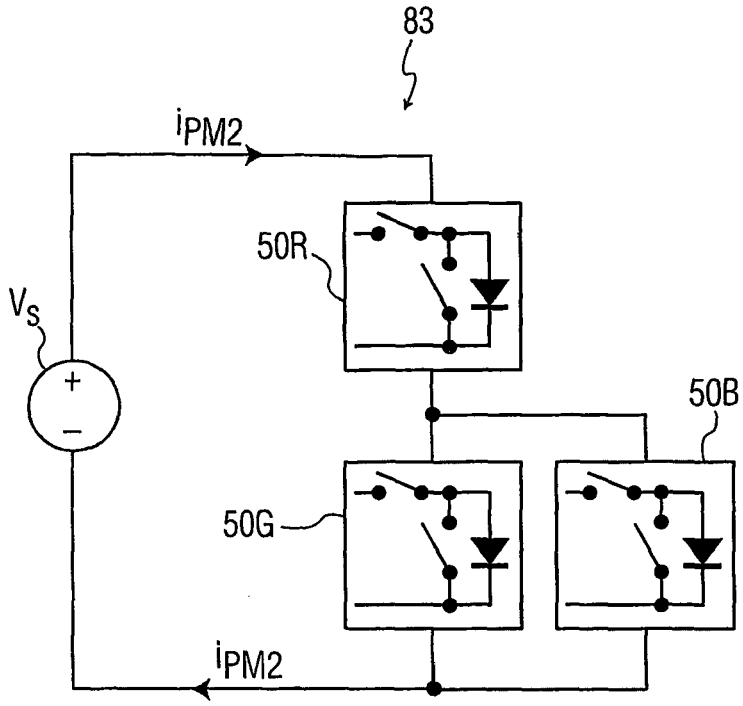
FIG. 28 illustrates a schematic diagram of a third embodiment in accordance with the present invention of the voltage source LED driver illustrated in FIG. 21.
Figure 29:
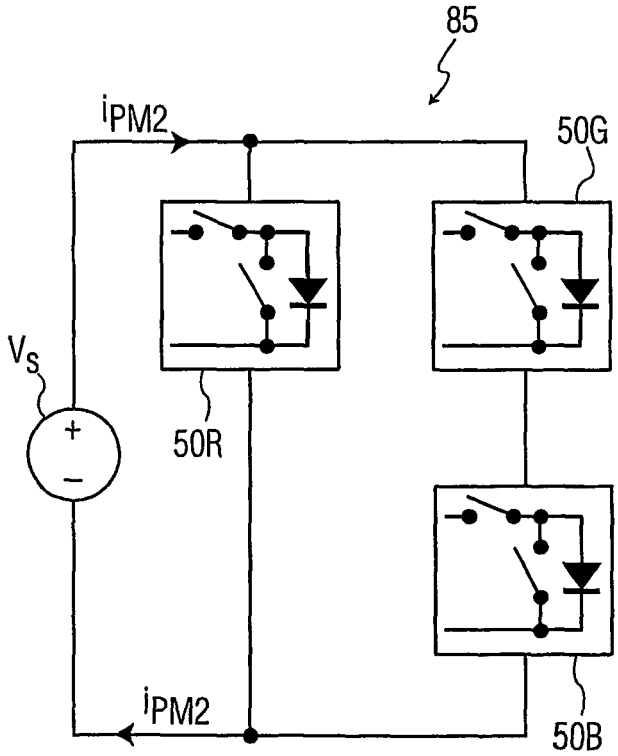
FIG. 29 illustrates a schematic diagram of a fourth embodiment in accordance with the present invention of the voltage source LED driver illustrated in FIG. 21.

FIG. 26 illustrates a red cell 50R, a green cell 50G, and a blue cell 50B connected in parallel to voltage source $V_S$. FIG. 27 illustrates red cell 50R, green cell 50G, and blue cell 50B connected in series to voltage source Vs. FIG. 28 illustrates red cell 50R connected in series voltage source $V_S$ and a parallel connection of green cell 50G and blue cell 50B. FIG. 29 illustrates red cell 50R and a series connection of green cell 50G and blue cell 50G connected in parallel to voltage source $V_S$. Referring to FIGS. 26-29, voltage source (e.g., $V_{S1}$ and $V_{S2}$ illustrated in FIGS. 18 and 19) provides pulse modulate current $I_{PM1}$ to cells 50R, 50G and 50B in dependence upon the switching of each cell 50R, 50G and 50B between their respective radiating and disabled modes at the same LED driving frequency or at various LED driving frequencies where current $I_{PM2}$ may consist of multiple pulse modulated currents at various LED driving frequencies.

Figure 30:
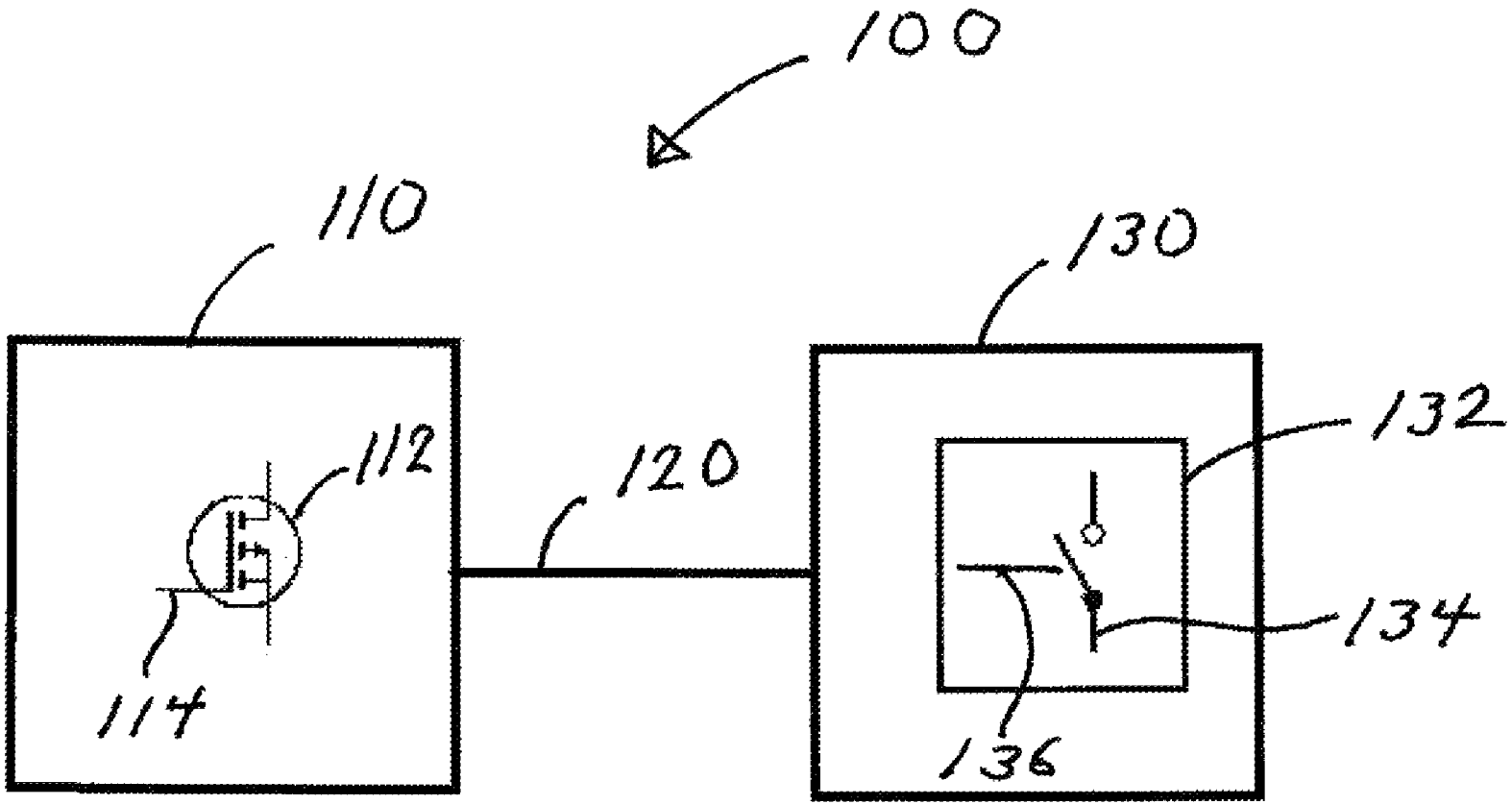
FIG. 30 illustrates a block diagram of an embodiment in accordance with the present invention of an LED driver circuit employing at least one switching LED cell.

FIG. 30 illustrates a block diagram of an embodiment in accordance with the present invention of an LED driver circuit employing at least one switching LED cell. The LED driver circuit 100 includes a power supply 110 providing power 120 to a cell matrix 130 including at least one switching LED cell 132.

The power supply 110, such as a current source or a voltage source, includes a semiconductor switch 112 which receives a gate signal 114 at a gate of the semiconductor switch 112 at a power conversion frequency (e.g., 100 KHz). Exemplary power supplies are illustrated in FIGS. 7-11 and FIGS. 18-19.

Referring to FIG. 30, the cell matrix 130 includes at least one switching LED cell 132 which includes at least one switch 134. The switch 134 receives a control signal 136 which operates the switch 134 to switch the switching LED cell 132 between the radiating mode and the disabled mode at a LED driving frequency (e.g., 200 Hz). When the switching LED cell 132 includes a number of switches, the switches can be individually operated at different LED driving frequencies or operated in groups at different LED driving frequencies. Exemplary cell matrices are illustrated in FIGS. 20-29 and exemplary switching LED cells with switches are illustrated in FIGS. 1-19.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A switching LED cell, comprising:

an input terminal operable to receive power at a first frequency, the first frequency being a single frequency;

an output terminal; and at least one LED between the input terminal and the output terminal operable to radiate a first color of light in response to a LED current flowing through said at least one LED; and at least one switch between the input terminal and the output terminal;

wherein said switching LED cell is operable to be switched between a radiating mode and a disabled mode at a LED driving frequency, wherein, during the radiating mode, the at least one switch controls flow of the LED current through said at least one LED whenever the power is applied between said input terminal and said output terminal, and wherein, during the disabled mode, the at least one switch impedes flow of the LED current through said at least one LED whenever the power is applied between said input terminal and said output terminal, wherein the at least one switch is a first at least one switch operable to be opened during the radiating mode and closed during the disabled mode, the switching LED cell further comprising:

a second at least one switch operable to be closed during the radiating mode and opened during the disabled mode.

2. The switching LED cell of claim 1, wherein the first switching frequency is greater than the LED driving frequency.

3. The switching LED of claim 1, wherein the power applied between the input terminal and output terminal is switched at a power switching frequency that is greater than the LED driving frequency.

4. The switching LED cell of claim 1, wherein both of the first at least one switch and the second at least one switch are switched at the LED driving frequency to have complementary states such that when the first at least one switch is open, then the second at least one switch is closed, and when the first at least one switch is closed, then the second at least one switch is open.

* * * * *